US011767688B2

(12) United States Patent
Akagi et al.

(10) Patent No.: US 11,767,688 B2
(45) Date of Patent: Sep. 26, 2023

(54) DOOR LATCH DEVICE

(71) Applicant: U-Shin Ltd., Nagano (JP)

(72) Inventors: Nobuya Akagi, Hiroshima (JP); Yuki Tanaka, Hiroshima (JP)

(73) Assignee: U-SHIN LTD., Nagano (JP)

( * ) Notice: Subject to any disclaimer, the term of this patent is extended or adjusted under 35 U.S.C. 154(b) by 311 days.

(21) Appl. No.: 17/416,789

(22) PCT Filed: Nov. 25, 2019

(86) PCT No.: PCT/JP2019/045974

§ 371 (c)(1),
(2) Date: Jun. 21, 2021

(87) PCT Pub. No.: WO2020/129542

PCT Pub. Date: Jun. 25, 2020

(65) Prior Publication Data

US 2022/0065005 A1 Mar. 3, 2022

(30) Foreign Application Priority Data

Dec. 20, 2018 (JP) ..... 2018-238708

(51) Int. Cl.
*E05B 81/16* (2014.01)
*E05B 81/06* (2014.01)
*E05B 81/34* (2014.01)

(52) U.S. Cl.
CPC ..... *E05B 81/16* (2013.01); *E05B 81/06* (2013.01); *E05B 81/34* (2013.01)

(58) Field of Classification Search
CPC ..... E05B 81/06; E05B 81/16; E05B 81/34; E05B 81/36; E05B 77/22; E05B 77/24;
(Continued)

(56) References Cited

U.S. PATENT DOCUMENTS

2008/0136195 A1 6/2008 Ooe et al.
2010/0171321 A1 7/2010 Akizuki et al.
(Continued)

FOREIGN PATENT DOCUMENTS

GB 2453017 A * 3/2009 ..... E05B 77/28
JP 2008-144402 6/2008
(Continued)

OTHER PUBLICATIONS

International Search Report dated Jan. 28, 2020 in International (PCT) Application No. PCT/JP2019/045974.

*Primary Examiner* — Christine M Mills
*Assistant Examiner* — Christopher F Callahan
(74) *Attorney, Agent, or Firm* — Wenderoth, Lind & Ponack, L.L.P.

(57) ABSTRACT

A door latch device includes a latch mechanism, an inner lever having a connection lever and an actuation lever, and a lock mechanism switching between unlocked and locked state. The lock mechanism includes a connection member capable of transmitting operation of the connection lever to the actuation lever, a first rotating lever rotated by a motor to first and second working positions, a second rotating lever rotatable to a first rotation position where the connection member is moved to an unlock position and a second rotation position where the connection member is moved to a lock position, a connection spring connecting the first rotating lever and the second rotating lever while allowing relative rotation of them, and a holding spring having a biasing force stronger than a biasing force of the connection spring and holds the first rotating lever at the first and second working positions.

17 Claims, 22 Drawing Sheets

(58) Field of Classification Search
CPC ..... E05B 77/245; E05B 77/26; E05B 77/265; Y10T 292/1082; Y10T 292/1047; Y10S 292/23; Y10S 292/65
See application file for complete search history.

(56) References Cited

U.S. PATENT DOCUMENTS

| | | | | |
|---|---|---|---|---|
| 2011/0254287 | A1 | 10/2011 | Akizuki et al. | |
| 2018/0112442 | A1* | 4/2018 | Enomoto | E05B 77/265 |
| 2018/0355643 | A1* | 12/2018 | Taurasi | E05B 81/16 |
| 2019/0234115 | A1* | 8/2019 | Seo | E05B 81/16 |
| 2020/0277808 | A1* | 9/2020 | Seo | E05B 77/32 |

FOREIGN PATENT DOCUMENTS

| | | |
|---|---|---|
| JP | 2009-167594 | 7/2009 |
| JP | 2010-190036 | 9/2010 |
| JP | 2011-220094 | 11/2011 |

* cited by examiner

DOOR LATCH DEVICE

This is a national phase application in the United States of International Patent Application No. PCT/JP2019/45974 with an international filing date of Nov. 25, 2019, which claims priority of Japanese Patent Application No. 2018-238708 filed on Dec. 20, 2018 the contents of which are incorporated herein by reference.

TECHNICAL FIELD

The present invention relates to a door latch device.

BACKGROUND ART

The door latch device disclosed in JP 2009-167594 A includes a latch mechanism for holding a door in a closed state, an opening mechanism for opening the latch mechanism, a main lock mechanism used every time a person gets in a vehicle, and a child lock mechanism used when a small child gets in a vehicle. Among them, the opening mechanism includes an inside lever that operates as an inner handle is operated and an open lever for causing the latch mechanism to perform opening driving. The child lock mechanism includes a bush for engaging the inside lever and the open lever, and a switching mechanism including a motor for moving the bush. The switching mechanism moves the bush to an unlock position where the operating force of the inside lever can be transmitted to the open lever and a lock position where the operating force cannot be transmitted to the open lever.

In the door latch device of JP 2009-167594 A, when the child lock mechanism is driven during the operation of the inner handle, the bush interferes with the inside lever. For this reason, the state of the child lock mechanism cannot be switched. That is, the child lock mechanism in the unlocked state cannot be switched to the locked state, and the child lock mechanism in the locked state cannot be switched to the unlocked state. Patent Document 1 does not consider any countermeasure against such a panic.

An object of the present invention is to provide a door latch device capable of reliably switching the lock mechanism even during operation of the inner handle.

Means for Solving the Problems

According to an aspect of the present invention, there is provided a door latch device including a latch mechanism that locks a striker and holds a door in a closed state, an inner lever that releases locking of the striker by the latch mechanism, and a first lock mechanism including a first motor for making switching between a first unlocked state in which operation of the inner lever is enabled and a first locked state in which operation of the inner lever is disabled. The inner lever includes a connection lever that is operated by operation of an inner handle, and an actuation lever for operating the latch mechanism, and the first lock mechanism includes a connection member movable to an unlock position where operation of the connection lever can be transmitted to the actuation lever and a lock position where operation of the connection lever cannot be transmitted to the actuation lever, a first rotating lever that is rotated by driving of the first motor to a first working position for moving the connection member to the unlock position and a second working position for moving the connection member to the lock position, a second rotating lever that has a rotation shaft located on a same axis as a rotation shaft of the first rotating lever, holds the connection member, and is rotatable between a first rotation position where the connection member is moved to the unlock position and a second rotation position where the connection member is moved to the lock position, a connection spring that rotatably connects the second rotating lever to the first rotating lever, allows rotation of the second rotating lever to the second rotation position with respect to the first rotating lever at the first working position and biases the second rotating lever toward the first rotation position, and allows rotation of the second rotating lever to the first rotation position with respect to the first rotating lever at the second working position and biases the second rotating lever toward the second rotation position, and a holding spring that has a biasing force stronger than a biasing force of the connection spring, biases the first rotating lever rotated to the first working position side beyond a specific position between the first working position and the second working position to the first working position and holds the first rotating lever, and biases the first rotating lever rotated to the second working position side beyond the specific position to the second working position and holds the first rotating lever.

According to this door latch device, the second rotating lever is biased by the connection spring toward the first rotation position while being allowed to rotate to the second rotation position with respect to the first rotating lever at the first working position. Therefore, in a case where the first lock mechanism is driven to unlock in a state where the connection member moves to the lock position and the inner lever (connection lever) is operated, the connection member interferes with the connection lever, so that the first rotating lever at the second working position is rotated to the first working position, while the second rotating lever is maintained in a state of being rotated to the second rotation position. Then, when the connection lever rotates to the non-operation position, the second rotating lever rotates to the first rotation position by the connection spring with respect to the first rotating lever held at the first working position by the holding spring, so that the connection member moves to the unlock position.

Further, the second rotating lever is biased by the connection spring toward the second rotation position while being allowed to rotate to the first rotation position with respect to the first rotating lever at the second working position. Therefore, in a case where the first lock mechanism is driven to lock in a state where the connection member moves to the unlock position and the connection lever is operated, the connection member interferes with the connection lever, so that the first rotating lever at the first working position is rotated to the second working position, while the second rotating lever is maintained in a state of being rotated to the first rotation position. Then, when the connection lever rotates to the non-operation position, the second rotating lever rotates to the second rotation position by the connection spring with respect to the first rotating lever held at the second working position by the holding spring, so that the connection member moves to the lock position.

As described above, even if the connection member interferes with the inner lever, the first lock mechanism can be switched to the unlocked state or the locked state after the end of the operation of the inner lever by the connection spring that connects the first rotating lever and the second rotating lever. Therefore, the safety of the door latch device can be improved.

Effect of the Invention

In the door latch device of the present invention, the lock mechanism can be reliably switched even during the operation of the inner handle.

DESCRIPTION OF EMBODIMENTS

Hereinafter, an embodiment of the present invention will be described with reference to the drawings.

Figure 1:
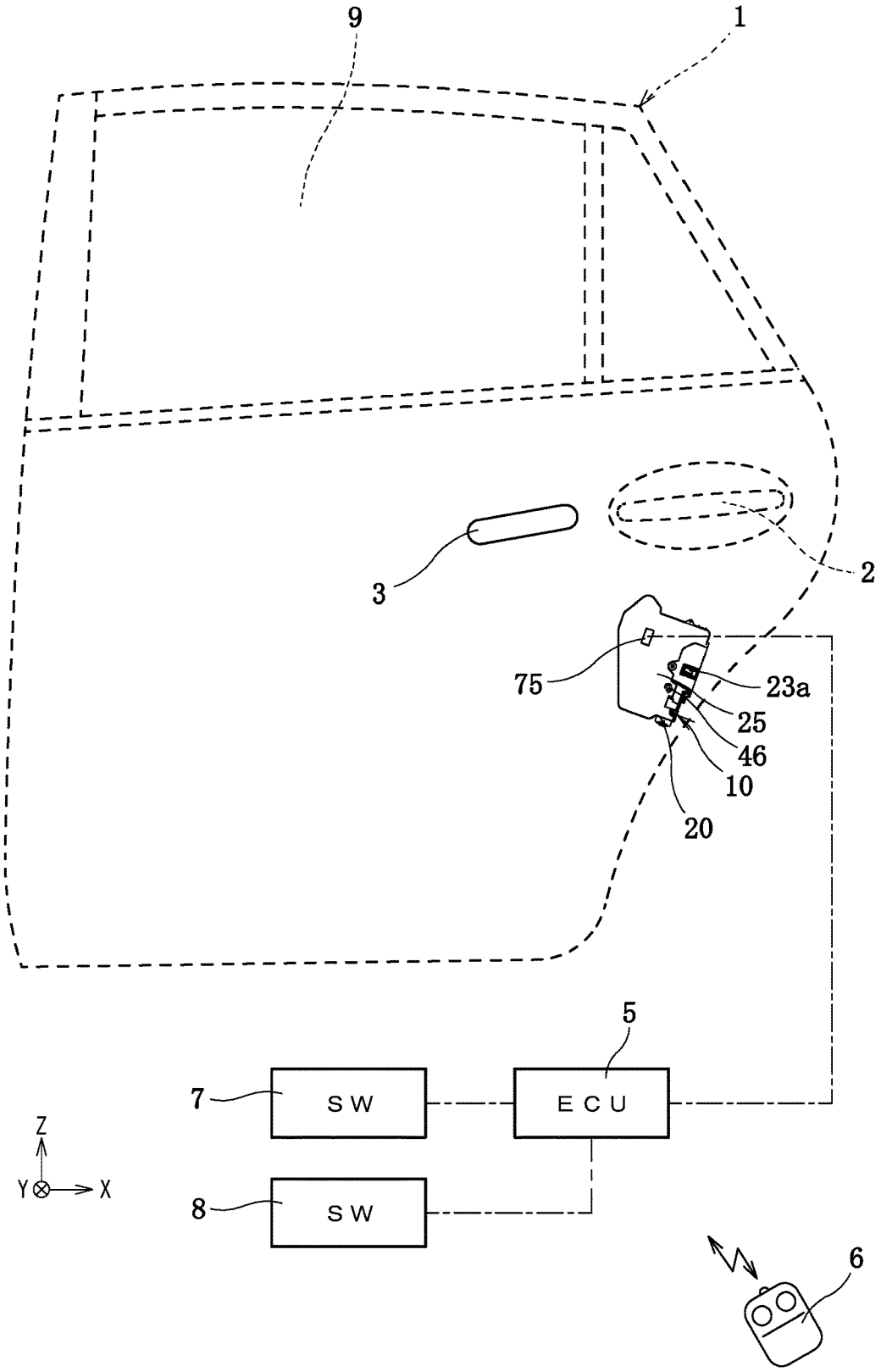
FIG. 1 is a schematic view illustrating a state where a door latch device according to an embodiment of the present invention is disposed in a door of a vehicle.
Figure 2:
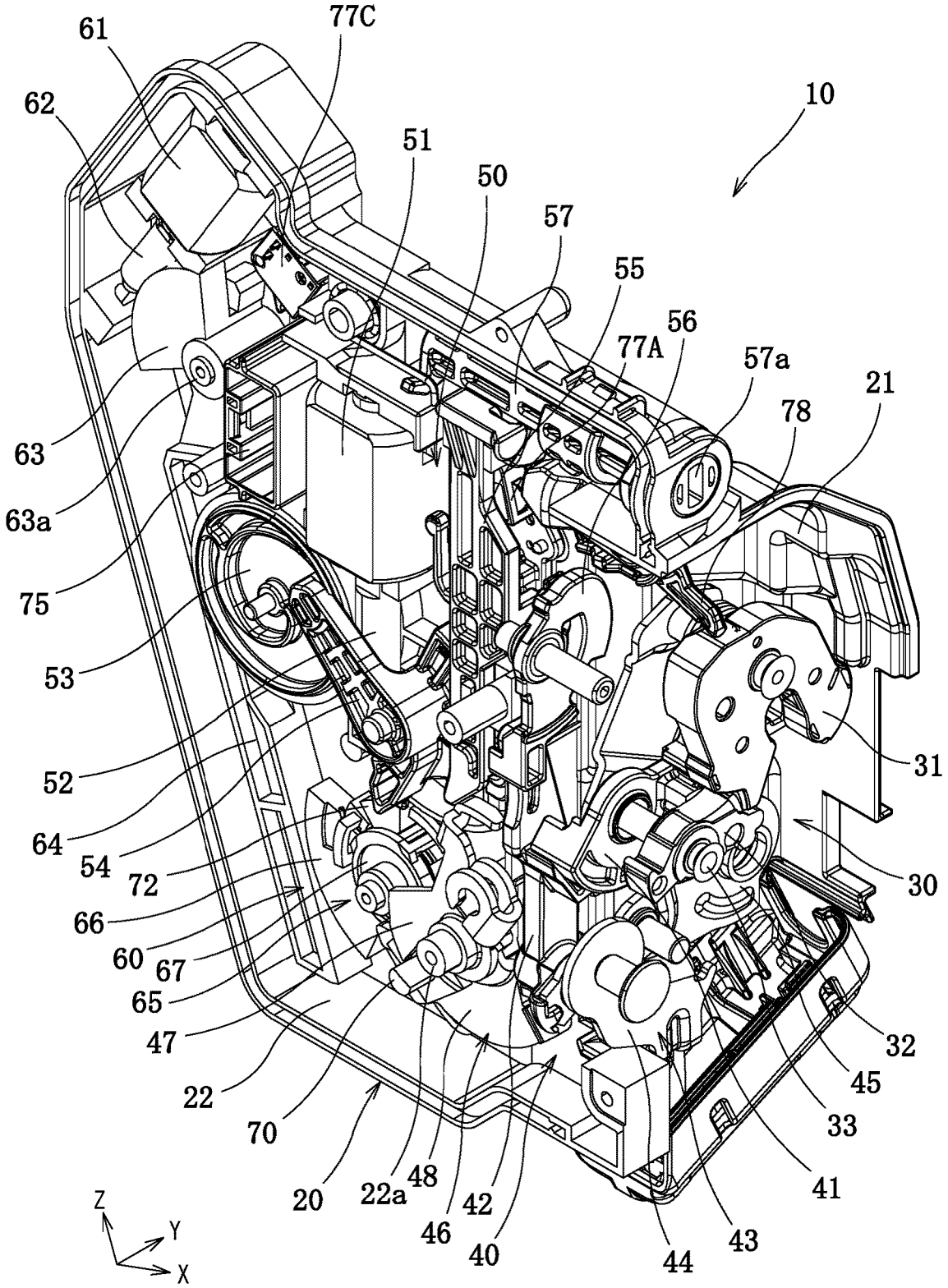
FIG. 2 is a perspective view of the door latch device.

FIGS. 1 and 2 show a door latch device 10 according to an embodiment of the present invention. As shown in FIG. 1, the door latch device 10 is disposed in a door 1 of a rear seat of a vehicle, and holds the door 1 in a closed state in an openable manner with respect to a vehicle body (not illustrated). The door 1 includes an outer handle 2 disposed outside the vehicle and an inner handle 3 disposed inside the vehicle. The door latch device 10 switches the operation of the outer handle 2 and the inner handle 3 for opening the door 1 between an unlocked state in which the operation is enabled and a locked state in which the operation is disabled. In description below, a vehicle length direction of the door 1 may be referred to as an X direction, a vehicle width direction of the door 1 may be referred to as a Y direction, and a vehicle height direction of the door 1 may be referred to as a Z direction.

Outline of Door Latch Device

As illustrated in FIG. 2, the door latch device 10 includes a latch mechanism 30, an opening mechanism 40, an electric main lock mechanism (second lock mechanism) 50, and an electric sub-lock mechanism (first lock mechanism) 60, which are disposed in a casing 20.

The latch mechanism 30 closes the door 1 with respect to the vehicle body to detachably lock a striker 4 (see FIG. 3B) disposed in the vehicle body, and holds the door 1 in a closed state. The opening mechanism 40 operates to release locking of the striker 4 by the latch mechanism 30 by the operation of the outer handle 2 and the inner handle 3. The main lock mechanism 50 switches the door latch device 10 between an unlocked state (second unlocked state) in which the operation of the opening mechanism 40 (the operation of the outer handle 2 and the inner handle 3) is enabled and a locked state (second locked state) in which the operation of the opening mechanism 40 is disabled. The sub-lock mechanism 60 switches the door latch device 10 between an unlocked state (first unlocked state) in which the operation of the inner handle 3 is enabled and a locked state (first locked state) in which the operation of the inner handle 3 is disabled.

Referring to FIG. 1, the door latch device 10 is electrically connected to an electronic control unit (ECU) 5 mounted on a vehicle, and is driven by a command of the ECU 5. When a key (portable device) 6 possessed by the user or a switch 7 provided in the vehicle is operated for unlocking, the main lock mechanism 50 of the door latch device 10 that receives a command output from the ECU 5 is driven to unlock. When the key 6 or the switch 7 is operated for locking, the main lock mechanism 50 of the door latch device 10 receiving a command output from the ECU 5 is driven to lock. When a switch 8 provided in the vehicle is operated for unlocking, the sub-lock mechanism 60 of the door latch device 10 that receives a command output from the ECU 5 is driven to unlock. When the switch 8 provided in the vehicle is operated for locking, the sub-lock mechanism 60 of the door latch device 10 that receives a command output from the ECU 5 is driven to lock.

Outline of Casing

Figure 3A:
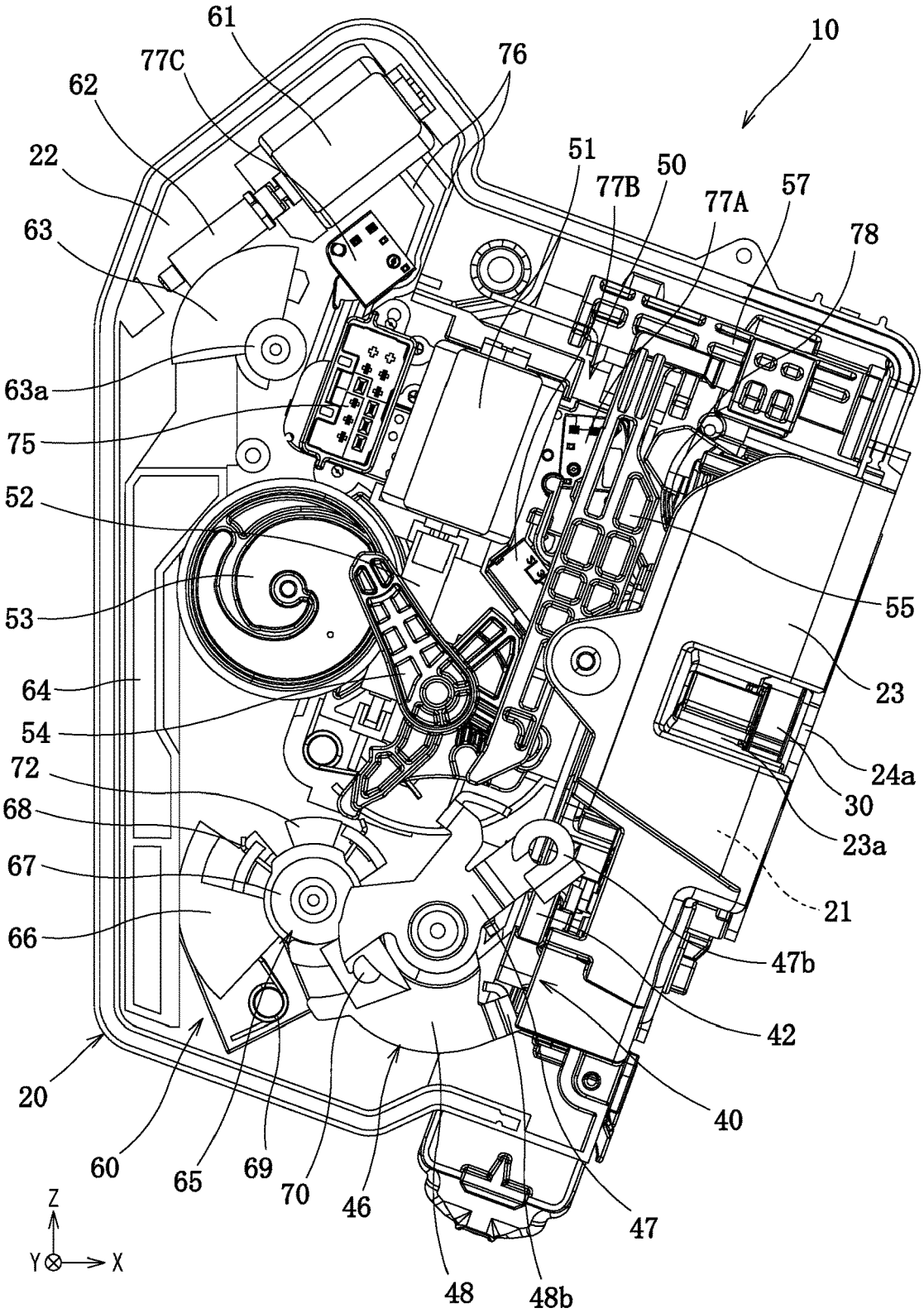
FIG. 3A is a front view of the door latch device.
Figure 3B:
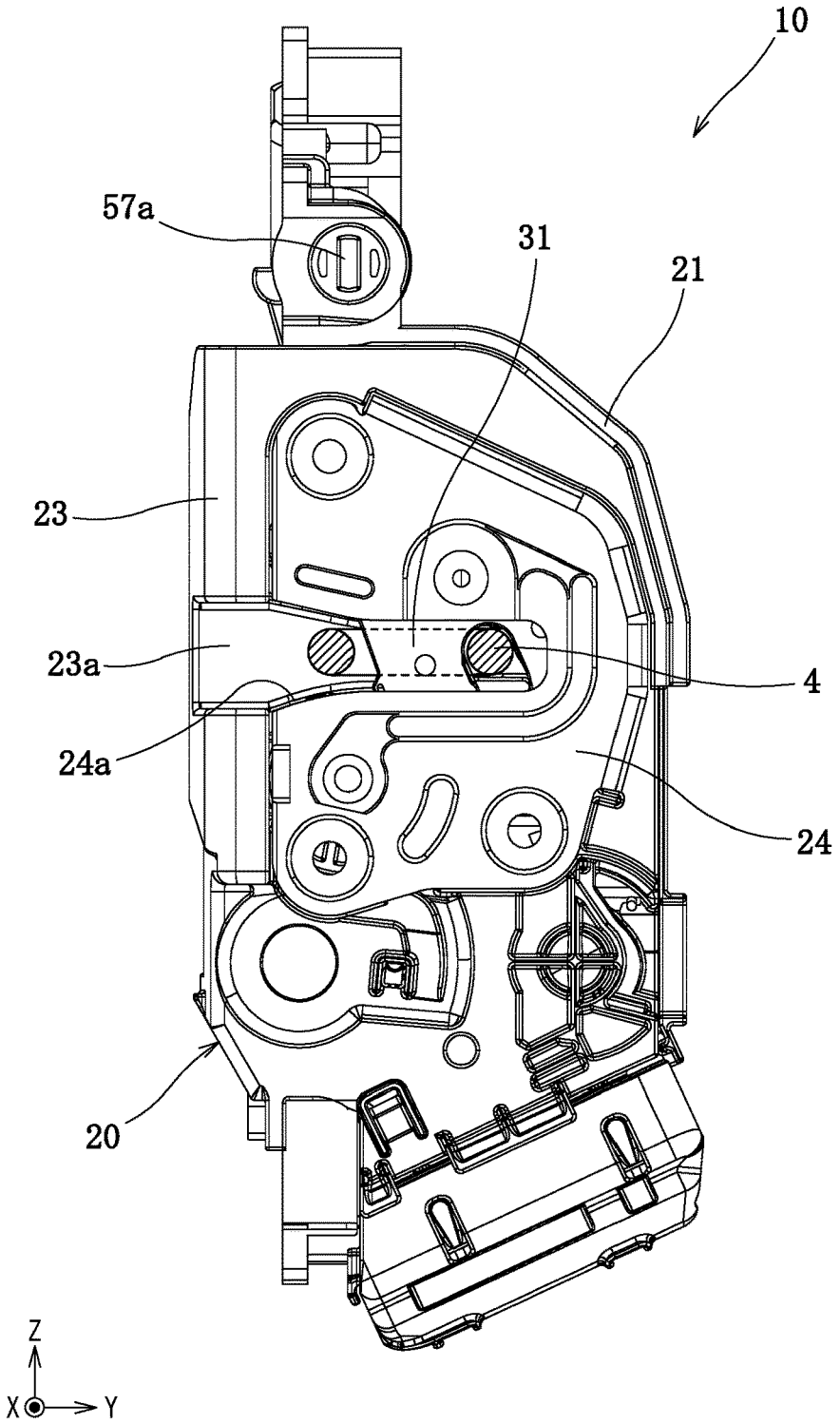
FIG. 3B is a side view of the door latch device.

As shown in FIGS. 2, 3A, and 3B, the casing 20 is made from resin, and includes a first housing portion 21 disposed along an end surface (substantially YZ plane) of the door 1 with respect to the door 1, and a second housing portion 22 disposed along an inner panel (XZ plane) of the door 1.

A fence block 23 made from resin is arranged in the first housing portion 21, and the latch mechanism 30, a part of the opening mechanism 40, and a part of the main lock mechanism 50 are disposed in the fence block 23. Note that the fence block 23 is not illustrated in FIG. 2. The rest of the opening mechanism 40, the rest of the main lock mechanism 50, and the sub-lock mechanism 60 are disposed in the second housing portion 22. Referring to FIG. 3B, a part of an end surface of the fence block 23 is covered with a metal cover 24. Referring to FIG. 1, the second housing portion 22 is covered with a resin cover 25.

As illustrated in FIGS. 3A and 3B, an insertion groove 23*a* through which the striker 4 is inserted is formed so as to be located substantially at the center in the entire height direction (Z direction) of the casing 20 in the fence block 23. The insertion groove 23*a* extends from the vehicle interior side to the vehicle exterior side in the vehicle width direction (Y direction), and is recessed from the rear side to the front side in the vehicle length direction (X direction). That is, the insertion groove 23*a* has a substantially U shape in which the X direction outer side located on the opposite side of a hinge connecting portion of the door 1 which is the rear side in the vehicle length direction and the vehicle interior side in the Y direction are opened. An insertion groove 24*a* corresponding to the insertion groove 23*a* is formed on the cover 24.

Outline of Latch Mechanism

Figure 4A:
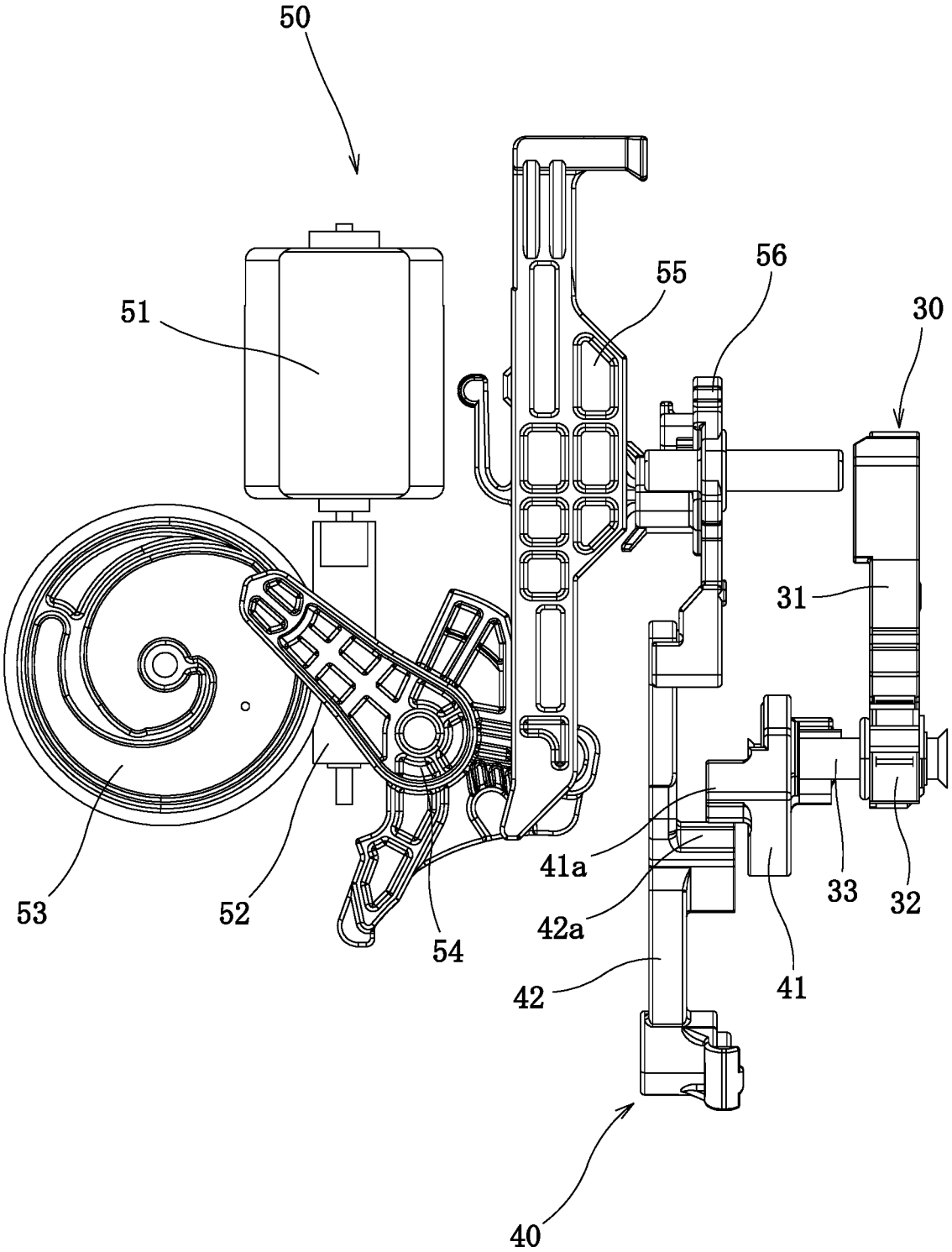
FIG. 4A is a front view illustrating a main lock mechanism and a latch mechanism.
Figure 4B:
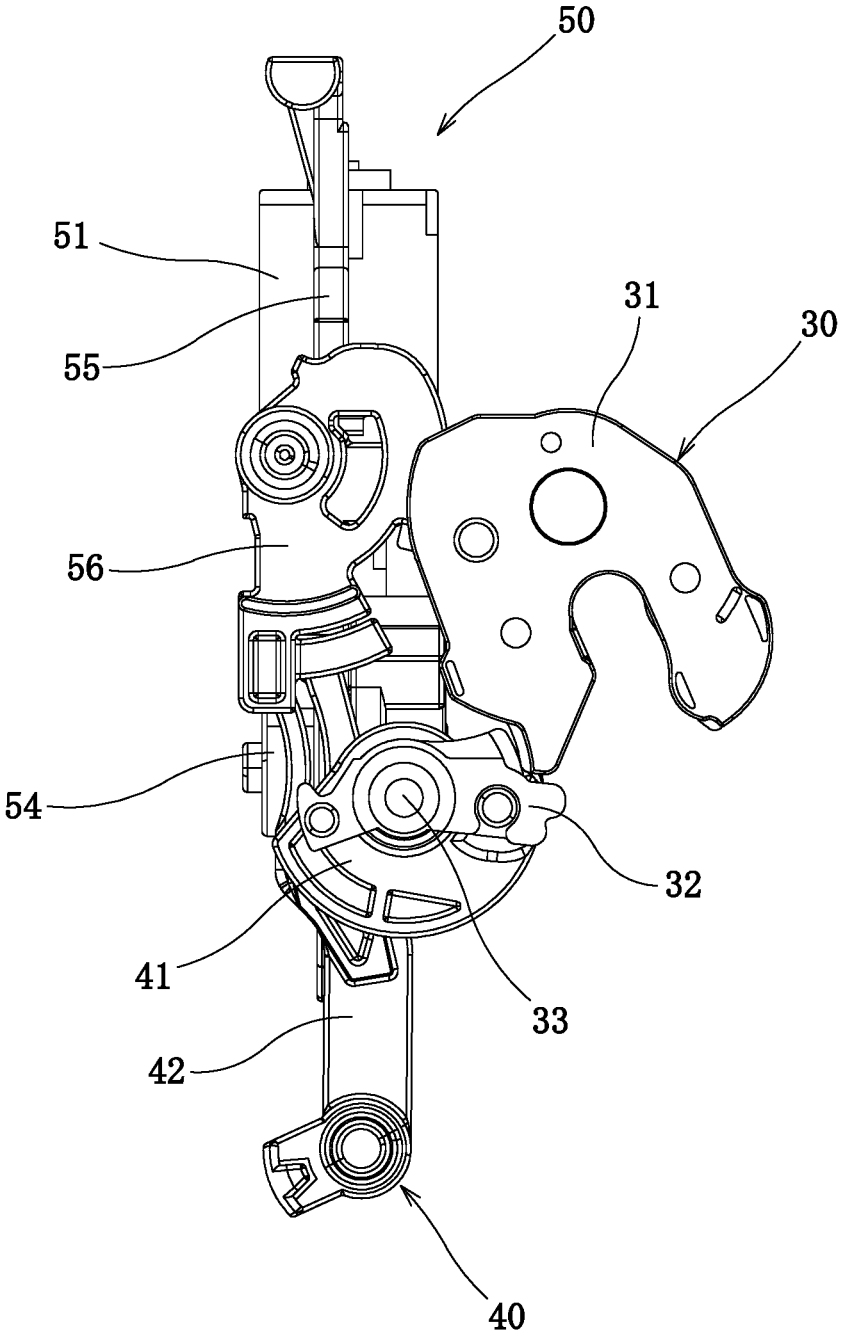
FIG. 4B is a side view illustrating the main lock mechanism and the latch mechanism.

As illustrated in FIGS. 2 and 4B, the latch mechanism 30 includes a fork 31 and a claw 32. The pressing of the striker 4 that has entered the insertion grooves 23*a* and 24*a* causes the fork 31 at the open position to rotate counterclockwise. When the claw 32 locks the fork 31 rotated to the latch position shown in FIG. 4B, the door 1 is held in a closed state. When the claw 32 at a locking position illustrated in FIG. 4B is rotated clockwise by the opening mechanism 40, the locking of the fork 31 by the claw 32 is released, and the fork 31 is rotated clockwise by a biasing force of a spring (not illustrated). When the fork 31 rotates to the open position, the striker 4 can be detached from the fork 31. The claw 32 whose operation by the opening mechanism 40 is stopped is rotated to the locking position by a biasing force of a spring (not illustrated).

Outline of Opening Mechanism

Referring to FIGS. 2 and 3A, the opening mechanism 40 includes an opening lever 41 connected to a same rotation shaft 33 as that of the claw 32, a link 42 for operating the opening lever 41, and an outer lever 43 and an inner lever 46 for operating the link 42. Note that the outer lever 43 is not illustrated in FIG. 3A. The outer lever 43 includes a connection lever 44 connected to the outer handle 2 via a cable (not illustrated) and an actuation lever 45 engaged with the link 42. The inner lever 46 includes a connection lever 47 connected to the inner handle 3 via a cable (not illustrated) and an actuation lever 48 for operating the link 42.

When the outer handle 2 is operated, the connection lever 44 rotates counterclockwise in FIG. 2, so that the actuation lever 45 rotates clockwise in FIG. 2. In this manner, the link 42 linearly moves toward the opening lever 41. When the inner handle 3 is operated, the connection lever 47 rotates counterclockwise in FIG. 2, so that the actuation lever 48 rotates counterclockwise in FIG. 2. In this manner, the link 42 linearly moves toward the opening lever 41. In a case where the main lock mechanism 50 is in the unlocked state, the link 42 abuts on the opening lever 41, and the opening lever 41 rotates clockwise in FIG. 4B. In this manner, the locking of the fork 31 by the claw 32 coupled with the opening lever 41 via the rotation shaft 33 is released. In a case where the main lock mechanism 50 is in the locked state, the link 42 cannot abut on the opening lever 41, and the locking of the fork 31 by the claw 32 cannot be released.

Outline of Main Lock Mechanism

As shown in FIGS. 2 and 3A, the main lock mechanism 50 switches the locking of the striker 4 by the latch mechanism 30 between the unlocked state in which the locking can be released by the operation of the outer handle 2 and the inner handle 3 and the locked state in which the locking cannot be released. That is, the main lock mechanism 50 switches the operation of both the handles 2 and 3 between an enabled state and a disabled state. Specifically, the main lock mechanism 50 includes a motor (second motor) 51, a worm 52, a worm wheel 53, a rotor 54, a joint 55, and a switching lever 56.

The motor 51 is disposed in the second housing portion 22 so as to be located above the insertion groove 23*a*. An output shaft of the motor 51 protrudes downward, and the worm 52 is attached to the output shaft. The worm wheel 53 is rotatably disposed in the second housing portion 22 so as to be adjacent to the worm 52 on the side opposite to the latch mechanism 30. The rotor 54 is rotatably disposed in the second housing portion 22 so as to be adjacent to the worm wheel 53 on the latch mechanism 30 side. The joint 55 is disposed in the second housing portion 22 so as to be adjacent to the rotor 54 on the latch mechanism 30 side. The switching lever 56 is located above the insertion groove 23*a*, and is disposed in a portion protruding toward the second housing portion 22 side of the fence block 23 (first housing portion 21) so as to be adjacent to the joint 55 on the latch mechanism 30 side.

Next, the operation of the main lock mechanism 50 will be described with reference to FIGS. 4A and 4B. Note that FIGS. 4A and 4B illustrate the unlocked state.

When the key 6 or the switch 7 is operated for locking, the motor 51 rotates forward according to a command of the ECU 5, so that the worm wheel 53 rotates clockwise in FIG. 4A via the worm 52. In this manner, the rotor 54 rotates counterclockwise in FIG. 4A, so that the joint 55 linearly moves upward in FIG. 4A. Further, the switching lever 56 at a rotation position illustrated in FIG. 4B rotates counterclockwise. In this manner, an upper end of the link 42 swings clockwise in FIG. 4B, and the link 42 stops at a lock position where an operation portion (see FIG. 4A) 42*a* is separated from an abutment portion (see FIG. 4A) 41*a* of the opening lever 41. In this locked state, even if the link 42 is linearly moved by the operation of the handles 2 and 3, the operation portion 42*a* idles without abutting on the abutment portion 41*a* of the opening lever 41, and the latch mechanism 30 cannot be driven to open by the opening mechanism 40. Therefore, the door 1 is maintained in the closed state.

When the key 6 or the switch 7 is operated for unlocking, the motor 51 rotates backward according to a command of the ECU 5, so that the worm wheel 53 rotates counterclockwise in FIG. 4A via the worm 52. In this manner, the rotor 54 rotates clockwise in FIG. 4A, so that the joint 55 linearly moves downward in FIG. 4A. Further, the switching lever 56 rotates clockwise and stops at the rotation position illustrated in FIG. 4B. In this manner, the upper end of the link 42 swings counterclockwise, and the link 42 stops at the unlock position illustrated in FIG. 4B. In this unlocked state, when the link 42 is linearly moved by the operation of the handles 2 and 3, the operation portion 42*a* abuts on the abutment portion 41*a* of the opening lever 41, and the latch mechanism 30 can be driven to open by the opening mechanism 40. Therefore, the door 1 in the closed state can be opened.

Note that a member denoted by reference numeral 57 in FIGS. 2 and 3A is an emergency shaft for mechanically driving the main lock mechanism 50 to lock in an emergency in which the motor 51 cannot be driven. The emergency shaft 57 is disposed in the second housing portion 22 so as to be located at an upper end of the joint 55. When a plate member (not illustrated) inserted into an insertion hole 57*a* shown in FIGS. 2 and 3B is operated clockwise, the columnar emergency shaft 57 rotates about an axis. In this manner, the joint 55 linearly moves upward, so that the switching lever 56 can be rotated via the joint 55 and the link 42 can be moved to the lock position.

Outline of Sub-Lock Mechanism

As shown in FIGS. 2 and 3A, the sub-lock mechanism 60 switches the locking of the striker 4 by the latch mechanism 30 between the unlocked state in which the locking can be released by the operation of the inner handle 3 (inner lever 46) and the locked state in which the locking cannot be released. That is, the sub-lock mechanism 60 switches only the operation of the inner handle 3 between the enabled state and the disabled state, and does not disable the operation of the outer handle 2. The sub-lock mechanism 60 can be used, for example, as a child lock function when a small child gets in a vehicle. Specifically, the sub-lock mechanism 60 includes a motor (first motor) 61, a worm 62, a worm wheel 63, a joint (transmission member) 64, a switching lever 65, and a bush (connection member) 70.

The motor 61 is disposed in the second housing portion 22 so as to be located above the insertion groove 23*a*. An output shaft of the motor 61 protrudes downward and is inclined in a direction away from the latch mechanism 30 toward the downward side, and the worm 62 is attached to the output shaft. The worm wheel 63 is rotatably disposed in the second housing portion 22 so as to be adjacent to the worm 62 on the latch mechanism 30 side. The joint 64 is adjacent to a shaft portion 63*a* of the worm wheel 63 on the side opposite to the latch mechanism 30, and is arranged to be linearly movable in the second housing portion 22 so as to extend in the vehicle height direction (Z direction). The switching lever 65 is located below the insertion groove 23*a*, is located between the joint 64 and the inner lever 46, and is rotatably disposed in the second housing portion 22 so as to be adjacent to these. The bush 70 is disposed on the switching lever 65.

Figure 5A:
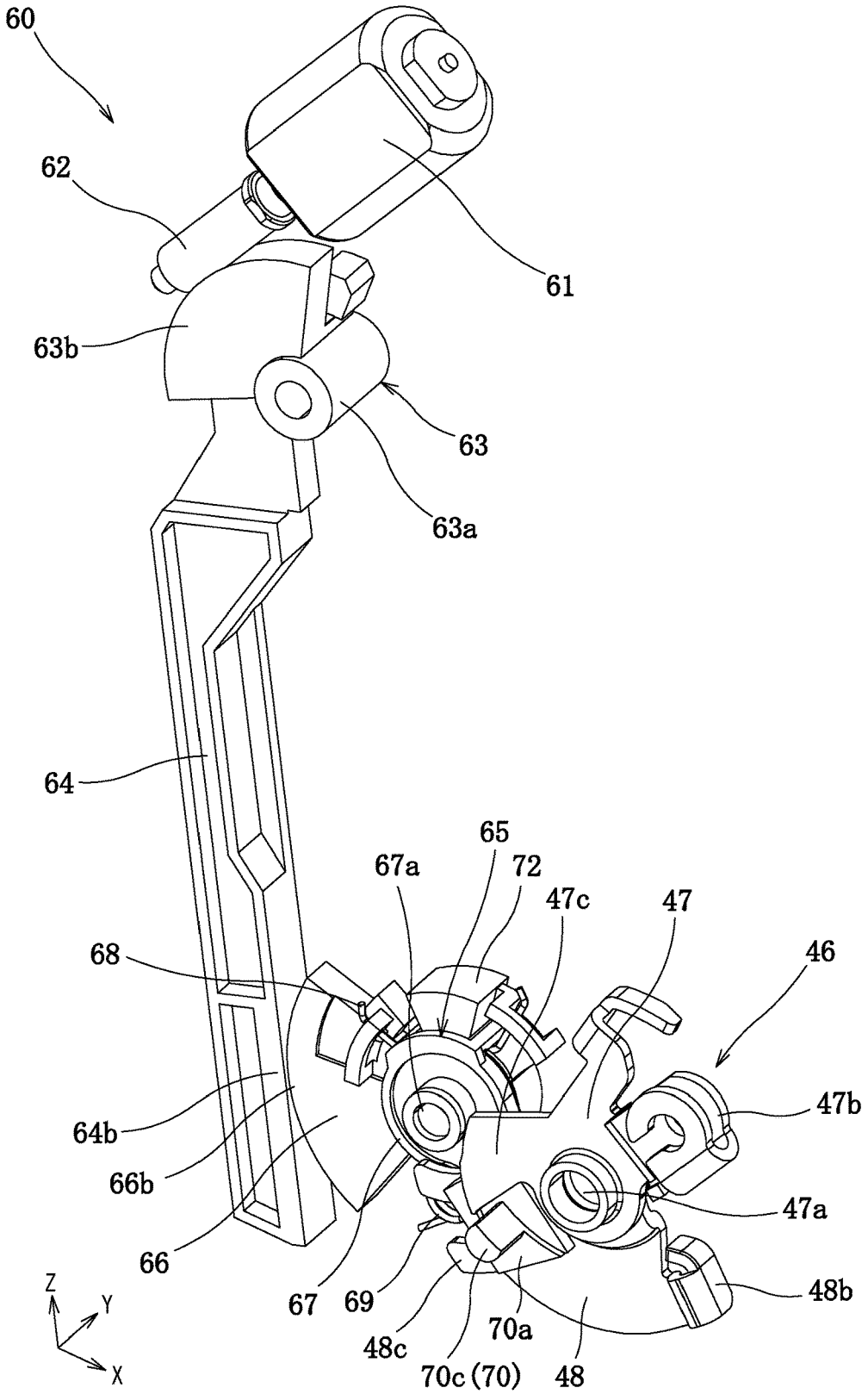
FIG. 5A is a perspective view illustrating a sub-lock mechanism.
Figure 5B:
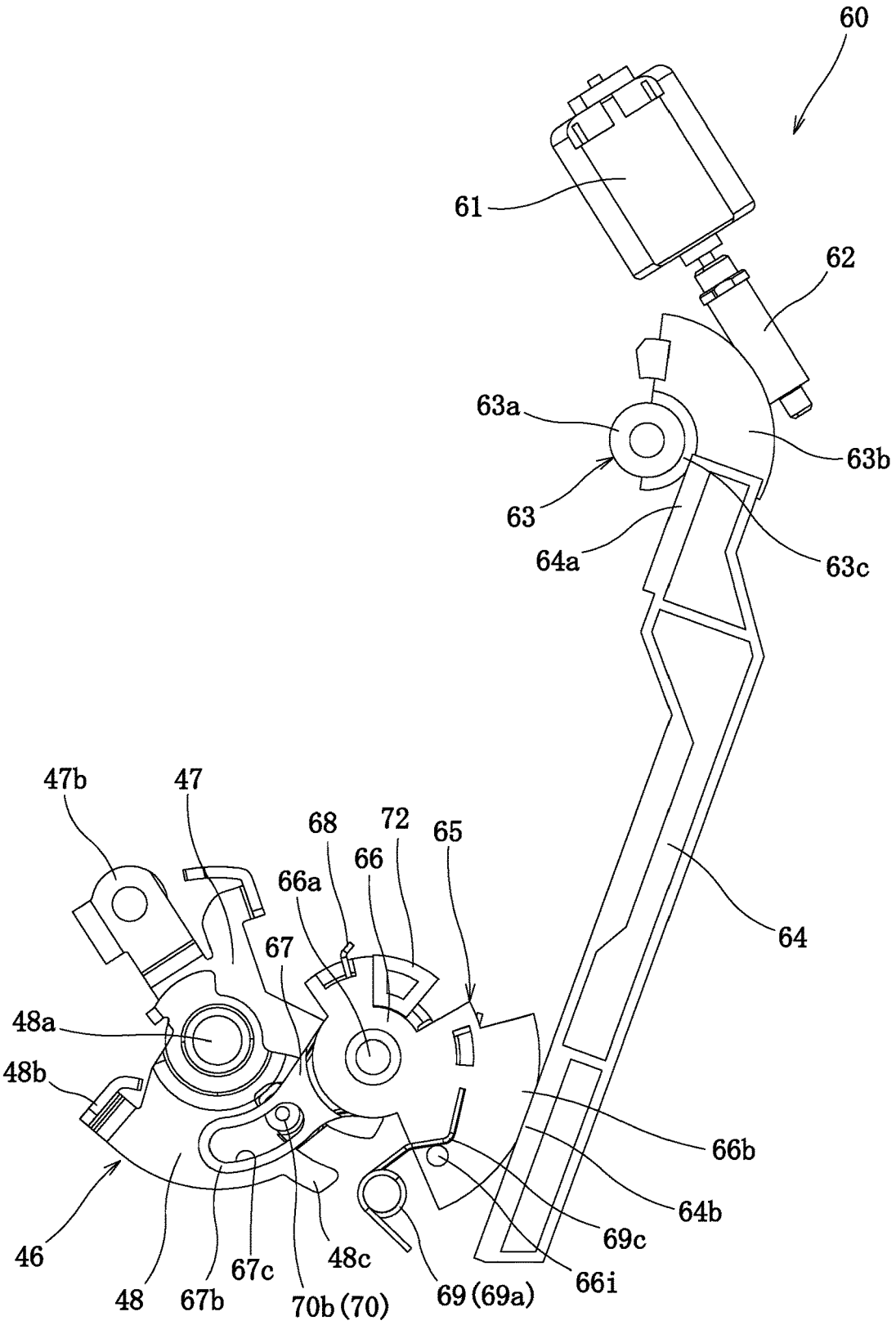
FIG. 5B is a rear view illustrating the sub-lock mechanism.

Referring to FIGS. 5A and 5B, the worm wheel 63 includes a first gear portion 63*b* with which the worm 62 meshes and a second gear portion 63*c* with which the joint 64 meshes. The first gear portion 63*b* protrudes from the shaft portion 63*a* in a fan shape, and teeth are formed on the outer periphery of the first gear portion 63*b*. The second gear portion 63*c* protrudes from the shaft portion 63*a* in a semi-annular shape, and teeth are formed on the outer periphery of the second gear portion 63*c*.

The joint 64 is a transmission member that transmits the driving force of the motor 61 to the switching lever 65, and extends from the upper side to the lower side of the insertion groove 23*a*. The joint 64 is disposed on the side opposite to the latch mechanism 30 with respect to the worm wheel 63. A first gear portion 64*a* meshing with the second gear portion 63*c* is formed on an upper portion of the joint 64. A second gear portion 64*b* meshing with the switching lever 65 is formed on a lower portion of the joint 64. Teeth are formed on each of the gear portions 64*a* and 64*b*. The latch mechanism 30 side of the joint 64 is supported by the worm wheel 63 and the switching lever 65, and the side opposite to the latch mechanism 30 of the joint 64 is supported by an outer peripheral wall of the second housing portion 22. Further, one surface of the joint 64 is supported by an arrangement surface (end wall) of the second housing portion 22, and the other surface of the joint 64 is supported by the first gear portion 63*b* of the worm wheel 63. In this manner, the joint 64 is guided so as to be linearly movable in a predetermined direction in the second housing portion 22.

The switching lever 65 includes a first rotating lever 66 and a second rotating lever 67 disposed to overlap each other in the Y direction. A shaft portion (rotation shaft) 66*a* of the first rotating lever 66 and a shaft portion (rotation shaft) 67*a* of the second rotating lever 67 are disposed on the same axis. The first rotating lever 66 and the second rotating lever 67 are relatively rotatably connected by a connection spring 68 disposed between them. Further, the first rotating lever 66 (switching lever 65) is biased by a holding spring 69 to a first working position illustrated in FIG. 6A and a second working position illustrated in FIG. 7A.

The first rotating lever 66 includes a fan-shaped gear portion 66*b* that protrudes radially outward from the shaft portion 66*a* and meshes with the second gear portion 64*b*. Teeth are formed on the outer periphery of the gear portion 66*b*. Referring to FIG. 5B, the second rotating lever 67 includes a holding portion 67*b* on which the bush 70 is disposed. The holding portion 67*b* protrudes radially outward from the shaft portion 67*a*, and includes the holding groove 67*c* for movably holding the bush 70. In a state where the second rotating lever 67 rotates to a first rotation position described later, the holding groove 67*c* is an arc oval around a rotation shaft 22*a* (see FIG. 2) of the inner lever 46.

The bush 70 is provided to make switching between the unlocked state in which the operation of the inner lever 46 (the operation of the inner handle 3) is enabled and the locked state in which the operation of the inner lever 46 is disabled. The bush 70 is moved to the unlock position illustrated in FIGS. 6A and 6B and the lock position illustrated in FIGS. 7A and 7B by the rotation of the switching lever 65. The bush 70 allows the operating force of the connection lever 47 to be transmitted to the actuation lever 48 at the unlock position, and does not allow the operating force of the connection lever 47 to be transmitted to the actuation lever 48 at the lock position. Specifically, as illustrated in FIG. 8, the bush 70 includes a rectangular substrate 70*a*, a mounting portion 70*b* disposed in the holding groove 67*c*, and a protruding portion 70*c* protruding toward an opening of the second housing portion 22.

Figure 8:
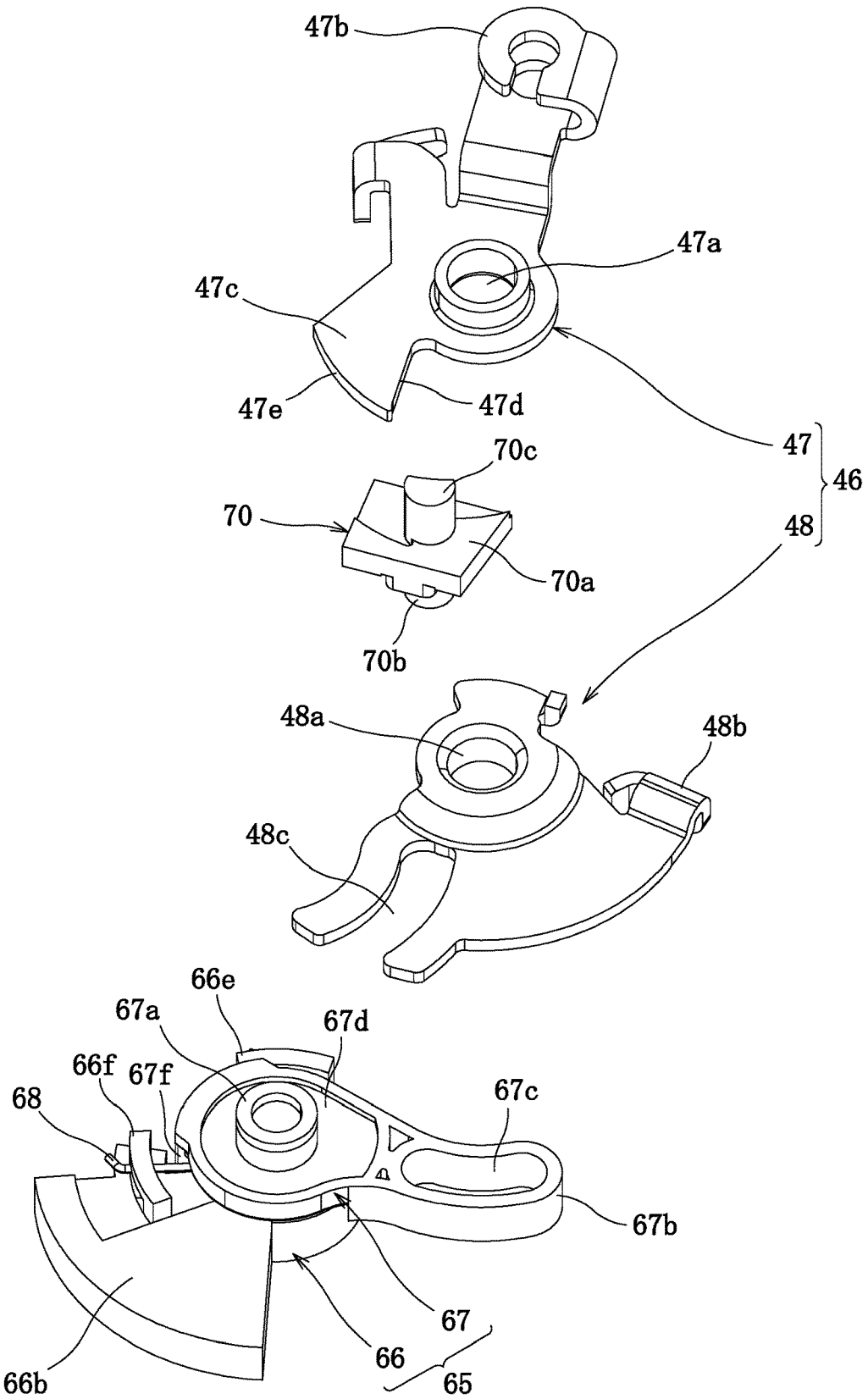
FIG. 8 is an exploded perspective view of a switching lever, a bush, and an inner lever.

Reference is made to FIG. 8 continuously, the inner lever 46 includes the connection lever 47 and the actuation lever 48 as previously described. These are rotatably attached to one of the rotation shaft 22*a* (see FIG. 2) protruding from the second housing portion 22.

The connection lever 47 includes a mounting hole 47*a* through which the rotation shaft 22*a* passes and a connection portion 47*b* connected to the inner handle 3. The connection lever 47 is provided with a protruding portion 47*c* protruding toward the protruding portion 70*c* of the bush 70. A side edge of the protruding portion 47*c* located on the right side in FIG. 8 is a pressing edge 47*d* for pressing the bush 70. When the connection lever 47 at a non-operation position illustrated in FIGS. 6A and 7A rotates to the operation position illustrated in FIGS. 6B and 7B, the pressing edge 47*d* can abut on the protruding portion 70*c* at the unlock position (see FIG. 6B) and cannot abut on the protruding portion 70*c* at the lock position (see FIG. 7B).

Figure 9A:
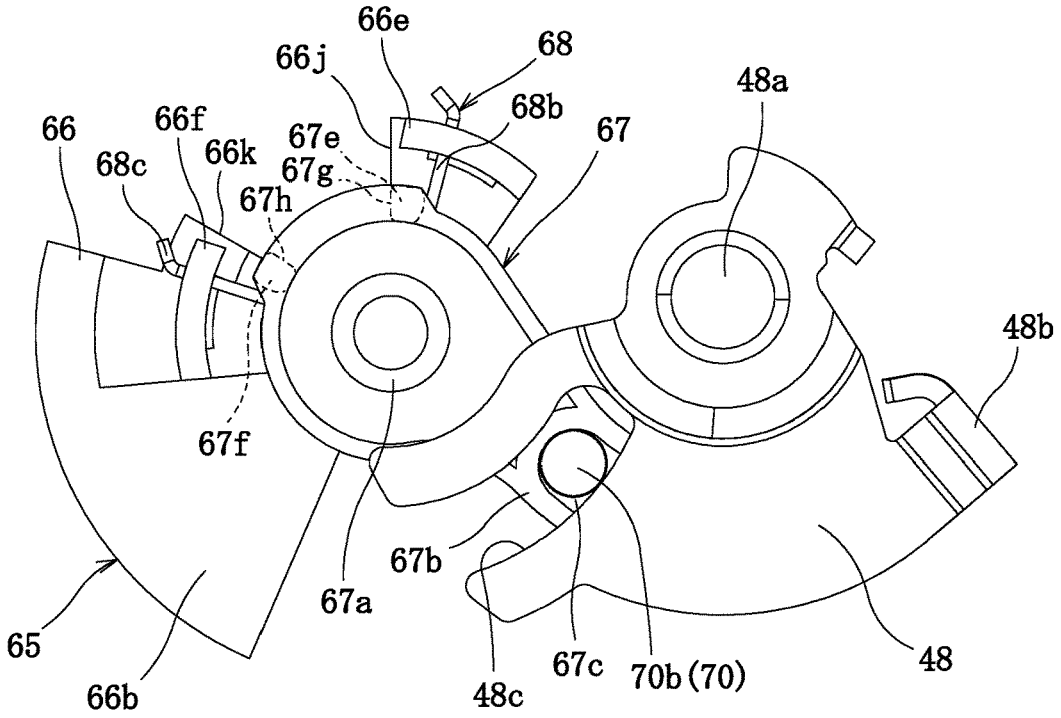
FIG. 9A is a front view illustrating a state of an actuation lever at a non-operation position with respect to the switching lever at a first working position.
Figure 9B:
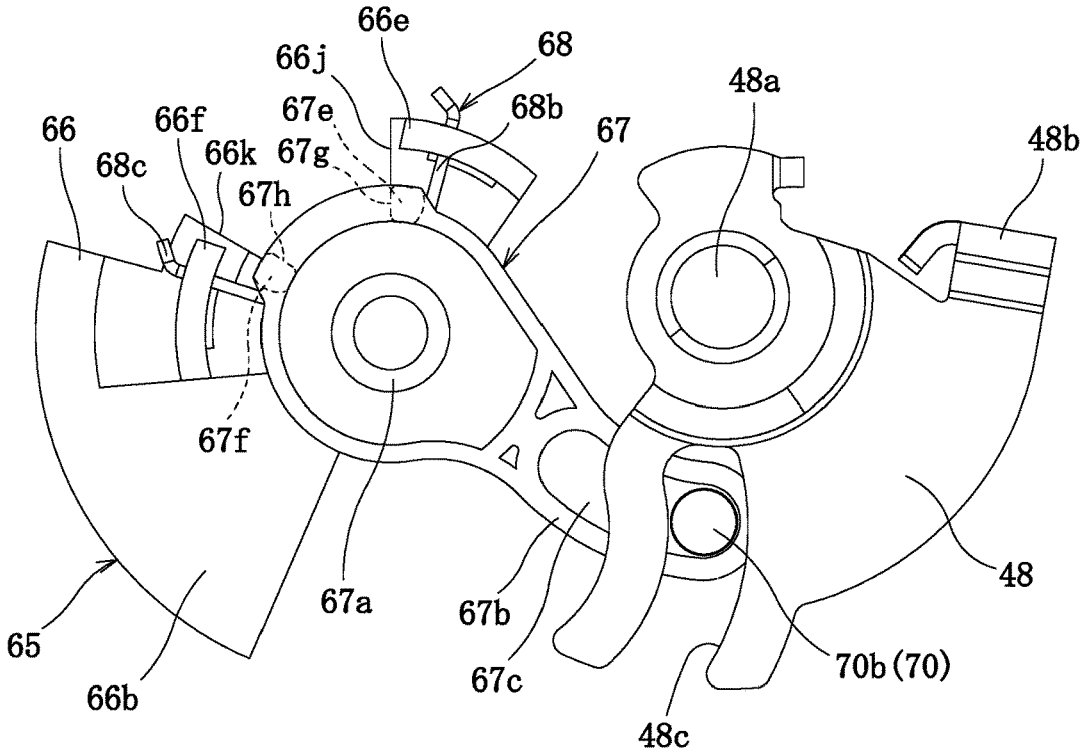
FIG. 9B is a front view illustrating a state of the actuation lever at an operation position with respect to the switching lever at the first working position.
Figure 9C:
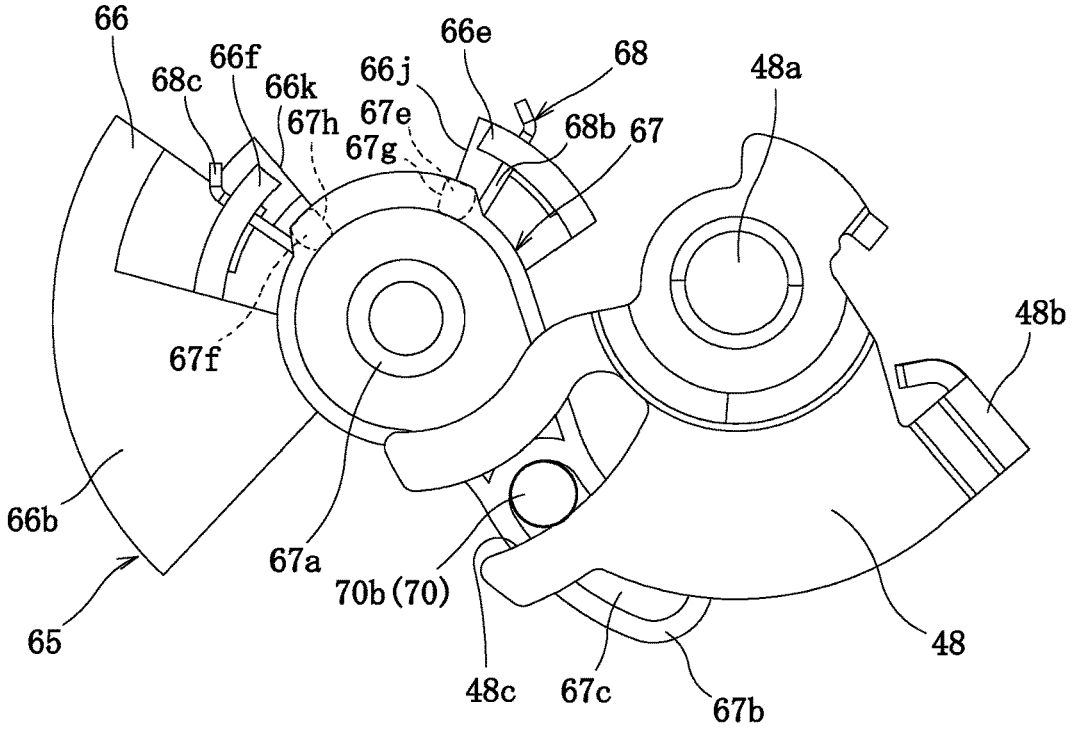
FIG. 9C is a front view illustrating a state of the actuation lever with respect to the switching lever at a second working position.

The actuation lever 48 includes a mounting hole 48*a* through which the rotation shaft 22*a* passes, and an actuating portion 48*b* that presses to linearly move the link 42 upward. A guide groove 48*c* for guiding the bush 70 to the unlock position and the lock position is formed on the actuation lever 48. In a state where the actuation lever 48 is rotated to the non-operation position, the guide groove 48*c* has an arc shape around shaft portions 66*a* and 67*a* of the switching lever 65. Referring to FIGS. 9A to 9C, the guide groove 48*c* of the actuation lever 48 and the holding groove 67*c* of the switching lever 65 cross each other. Therefore, as the mounting portion 70*b* is disposed in the holding groove 67*c* by penetrating the guide groove 48*c*, the operation of the connection lever 47 is transmitted to the actuation lever 48 via the bush 70 at the unlock position.

Next, the operation of the sub-lock mechanism 60 will be described with reference to FIGS. 6A and 6B and FIGS. 7A and 7B. Note that FIGS. 6A and 6B illustrate the unlocked state, and FIGS. 7A and 7B illustrate the locked state.

Figure 6A:
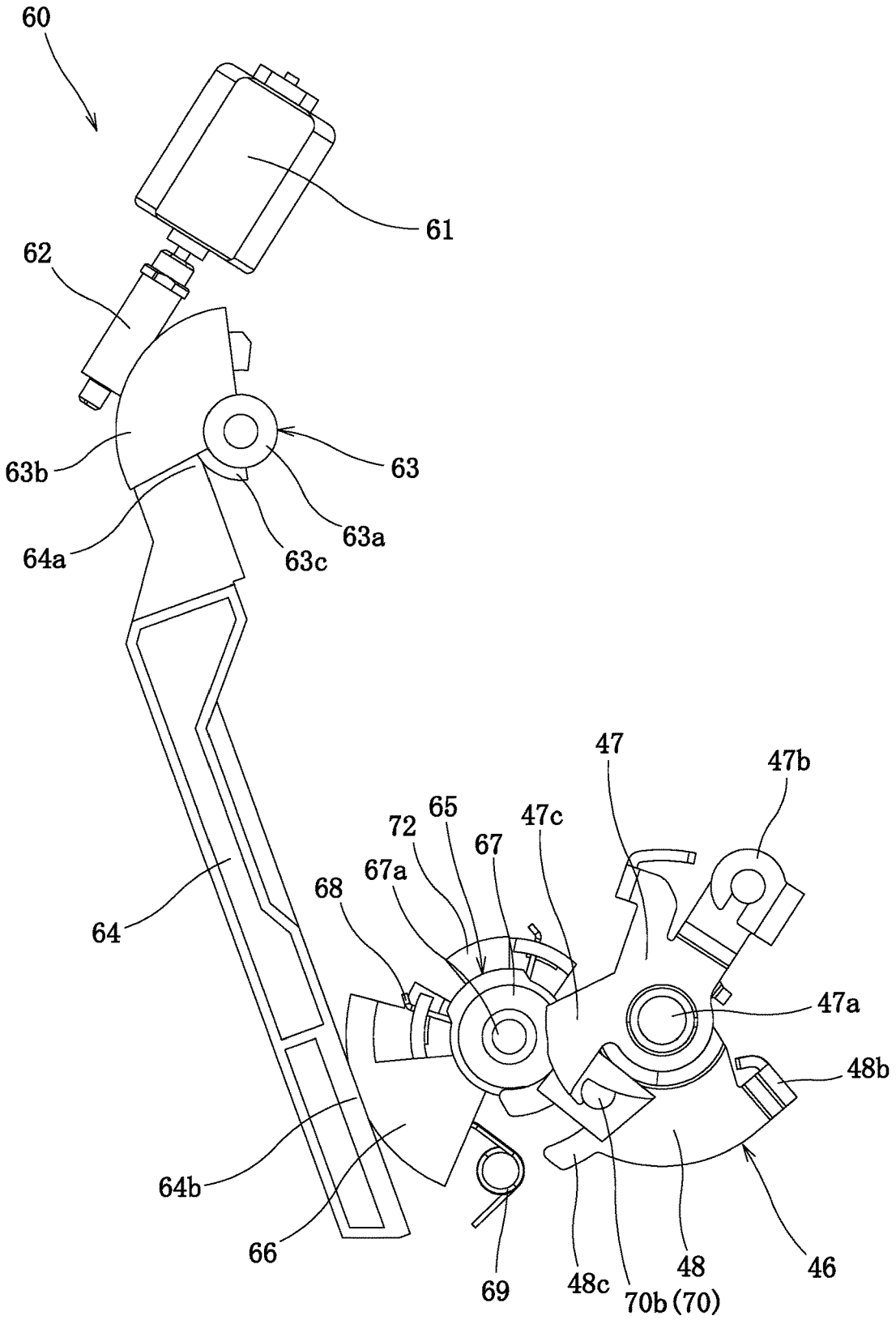
FIG. 6A is a front view illustrating the sub-lock mechanism in an unlocked state.
Figure 7A:
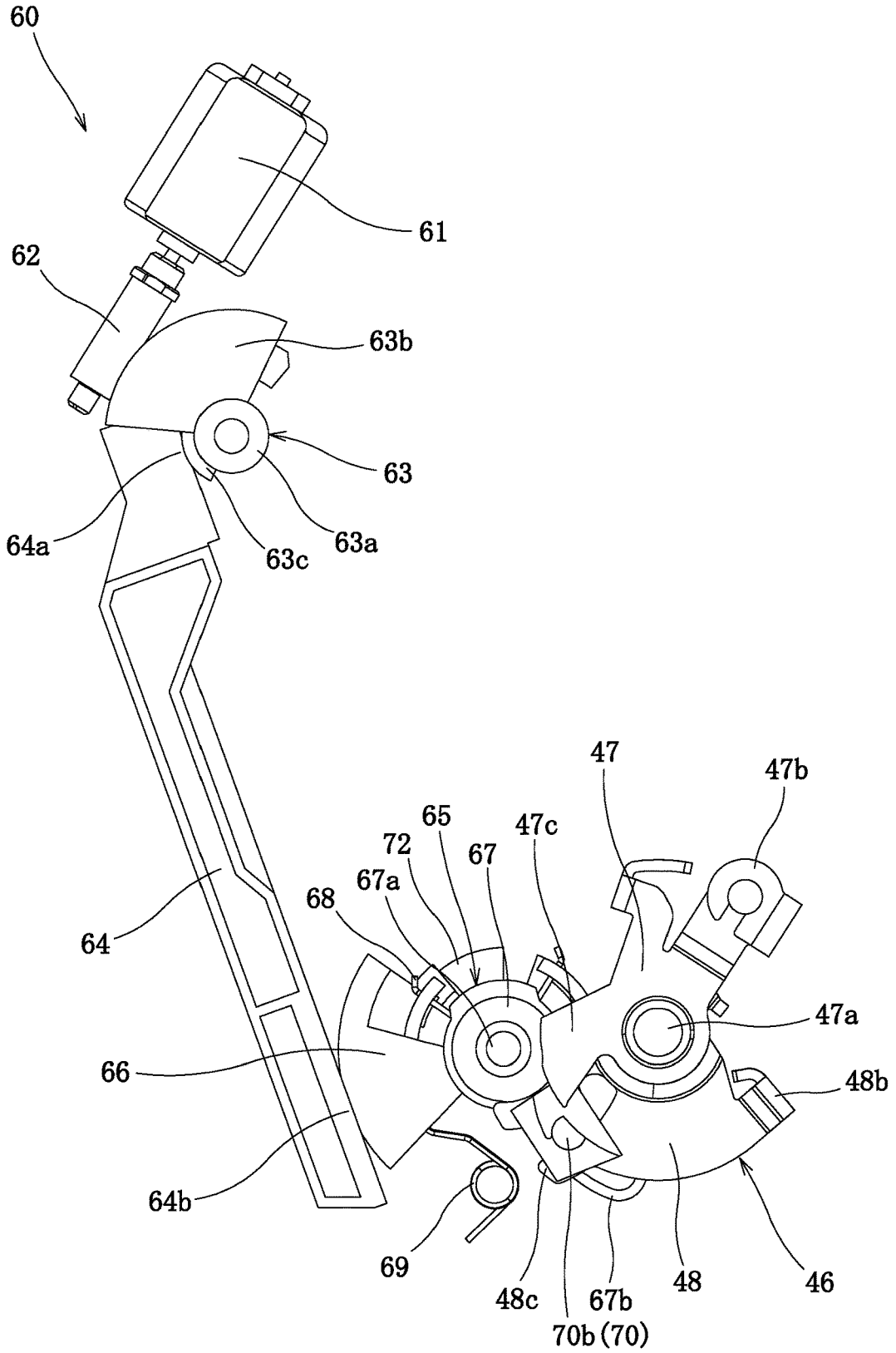
FIG. 7A is a front view illustrating the sub-lock mechanism in a locked state.
Figure 7B:
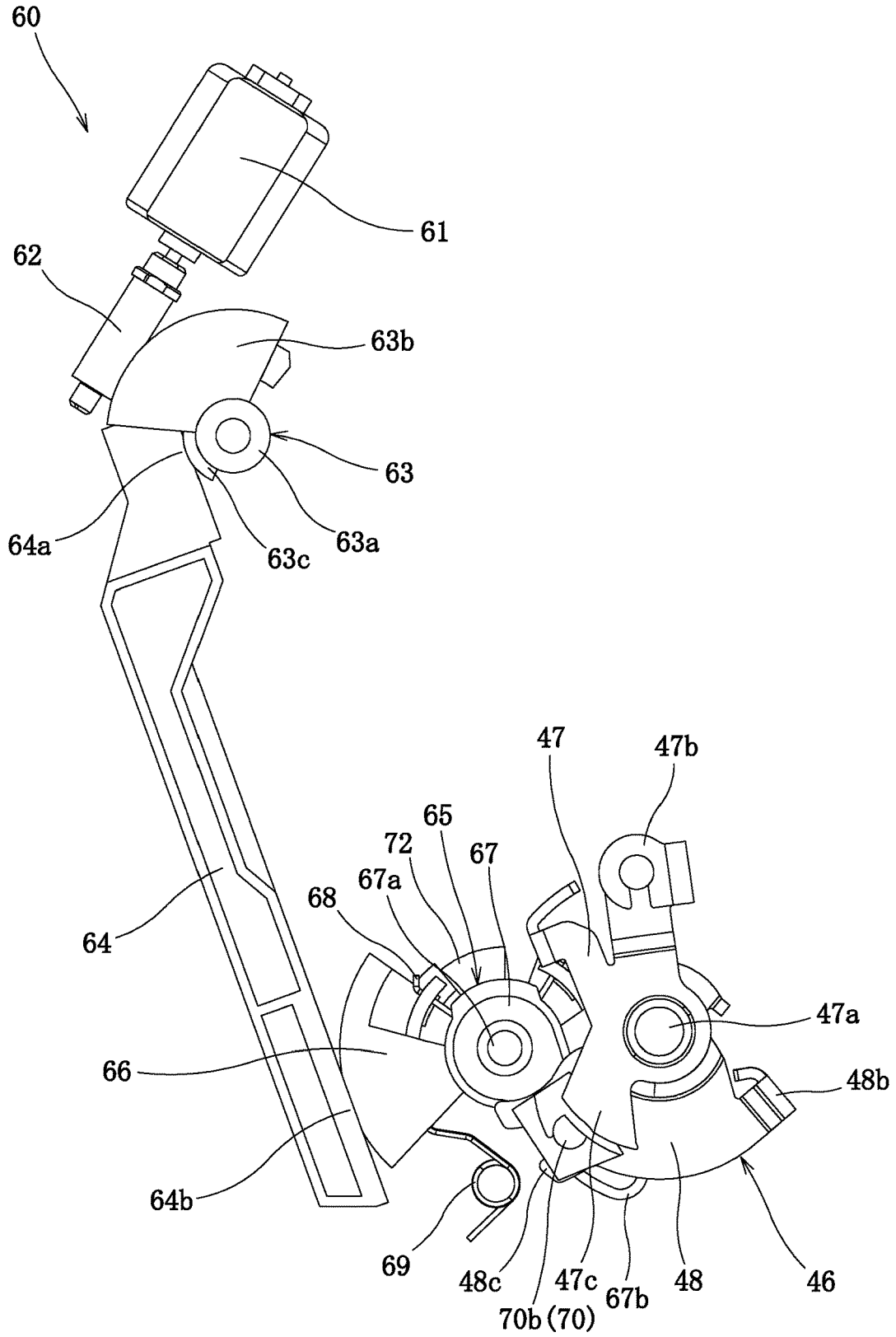
FIG. 7B is a front view illustrating an operation state of the sub-lock mechanism in the locked state.

When the switch (child lock changeover switch) 8 is operated for unlocking when the sub-lock mechanism 60 is in the locked state, the motor 61 rotates forward according to a command of the ECU 5, so that each component moves from the position illustrated in FIG. 7A to the position illustrated in FIG. 6A. Specifically, when the worm wheel 63 rotates counterclockwise via the worm 62, the joint 64 linearly moves downward. Further, referring also to FIGS. 9C and 9A, when the switching lever 65 at the second working position rotates counterclockwise, the bush 70 moves into a rotation track of the protruding portion 47*c*. In this manner, the sub-lock mechanism 60 in the locked state is switched to the unlocked state. Note that, in a case where the switch 8 is operated for unlocking in the unlocked state, the sub-lock mechanism 60 is not driven to unlock.

Figure 6B:
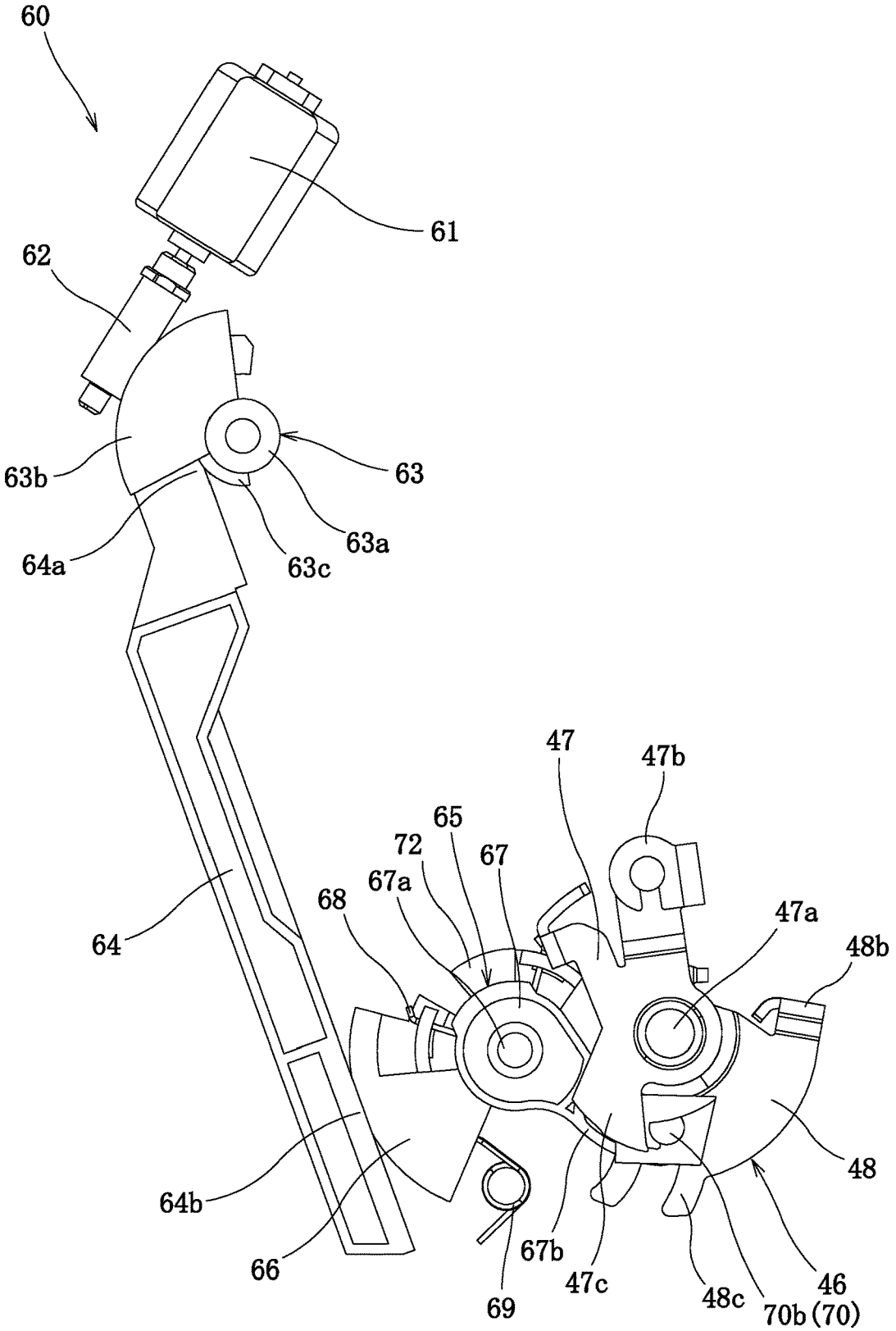
FIG. 6B is a front view illustrating an operation state of the sub-lock mechanism in the unlocked state.

When the inner handle 3 is operated in the unlocked state illustrated in FIG. 6A, the connection lever 47 rotates counterclockwise as illustrated in FIG. 6B. Further, referring also to FIGS. 9A and 9B, when the protruding portion 47*c* of the connection lever 47 presses the protruding portion 70*c* of the bush 70, the actuation lever 48 rotates counterclockwise via the bush 70. In this manner, since the link 42 illustrated in FIG. 4A moves toward the opening lever 41, the latch mechanism 30 is driven to open in a case where the main lock mechanism 50 is in the unlocked state. As a result, the door 1 in the closed state can be opened. However, in a case where the main lock mechanism 50 is in the locked state, the link 42 idles, and thus the latch mechanism 30 cannot be driven to open. As a result, the door 1 is maintained in the closed state.

When the switch 8 is operated for unlocking when the sub-lock mechanism 60 is in the unlocked state, the motor 61 rotates backward according to a command of the ECU 5, so that each component moves from the position illustrated in FIG. 6A to the position illustrated in FIG. 7A. Specifically, when the worm wheel 63 rotates clockwise via the worm 62, the joint 64 linearly moves upward. Further, referring also to FIGS. 9A and 9C, when the switching lever 65 at the first working position rotates clockwise, the bush 70 moves out of the rotation track of the protruding portion 47*c*. In this manner, the sub-lock mechanism 60 in the unlocked state is switched to the locked state. Note that, in a case where the switch 8 is operated for locking in the locked state, the sub-lock mechanism 60 is not driven to lock.

When the inner handle 3 is operated in the locked state illustrated in FIG. 7A, the connection lever 47 rotates counterclockwise as in the case of the unlocked state. However, since the bush 70 moves out of the rotation track of the protruding portion 47*c*, as illustrated in FIG. 7B, the protruding portion 47*c* cannot press the bush 70 and idles. Therefore, since the actuation lever 48 does not rotate counterclockwise, the latch mechanism 30 cannot be driven to open via the opening mechanism 40. As a result, the door 1 is maintained in the closed state.

Outline of Arrangement of Electric Components

As illustrated in FIG. 3A, the door latch device 10 includes, as electric components, the motor 51 of the main lock mechanism 50, the motor 61 of the sub-lock mechanism 60, and three detection switches 77A to 77C. In order to electrically connect these components to the ECU 5 and a battery (not illustrated), the door latch device 10 further includes a connector 75 and a bus bar 76. These are disposed in the second housing portion 22 so as to be located above the insertion groove 23*a* that is possibly immersed in water by being exposed to the outside of the vehicle.

Note that the detection switch 77A detects whether the fork 31 is rotated to the latch position or the open position via a detection member 78 (see FIG. 2). The detection switch 77B detects the rotation position of the rotor 54 to detect whether the main lock mechanism 50 is in the unlocked state or the locked state. The detection switch 77C detects the rotation position of the worm wheel 63 in order to detect whether the sub-lock mechanism 60 is in the unlocked state or the locked state.

As described above, since the electric components of the door latch device 10 are disposed above insertion groove 23*a*, it is possible to prevent a failure or a short circuit of the electric components due to water entering casing 20 through insertion groove 23*a*. Further, even if water enters the casing 20 from an exposed hole of the inner lever 46 on a cable connecting the inner handle 3 and the inner lever 46, the electric components do not fail or short-circuit.

Panic Countermeasure Structure of Sub-Lock Mechanism

As illustrated in FIG. 7B, the sub-lock mechanism 60 may be driven to unlock in a state where the bush 70 moves to the lock position and the connection lever 47 rotates to the operation position. Further, as illustrated in FIG. 6B, the sub-lock mechanism 60 may be driven to lock in a state where the bush 70 moves to the unlock position and the connection lever 47 (inner lever 46) rotates to the operation position. In these cases, the bush 70, which interferes with the protruding portion 47*c* of the connection lever 47, cannot be moved to the unlock position or the lock position by resistance. The door latch device 10 of the present embodiment is provided with a panic countermeasure for preventing such inconvenience.

Figure 10A:
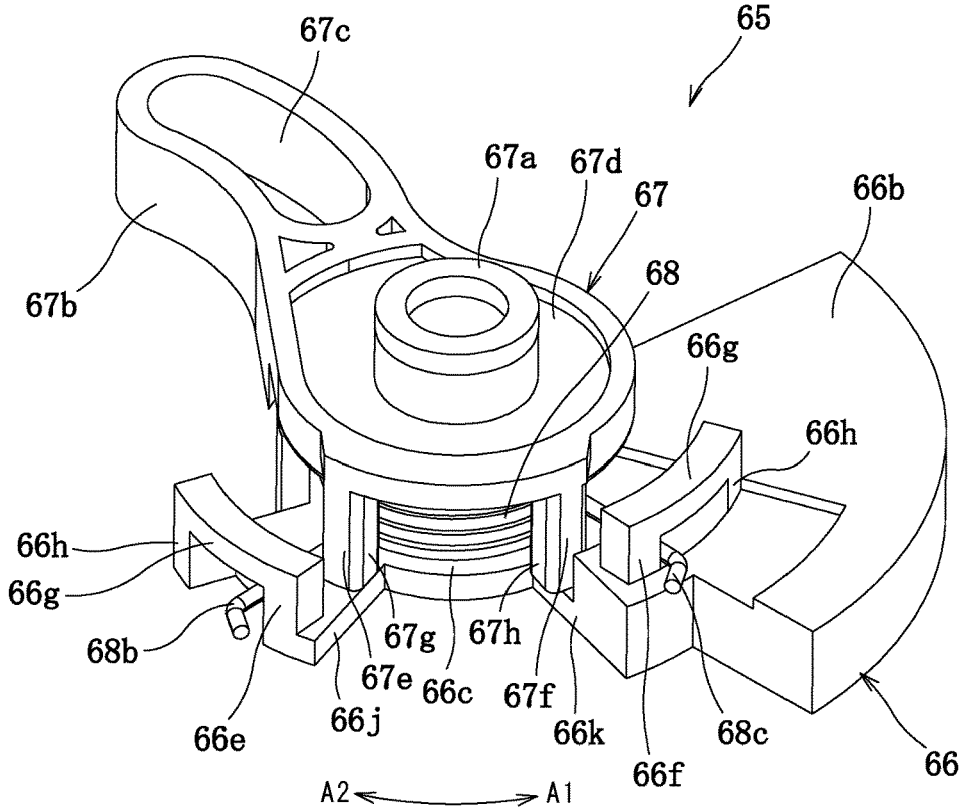
FIG. 10A is a perspective view of the switching lever.
Figure 10B:
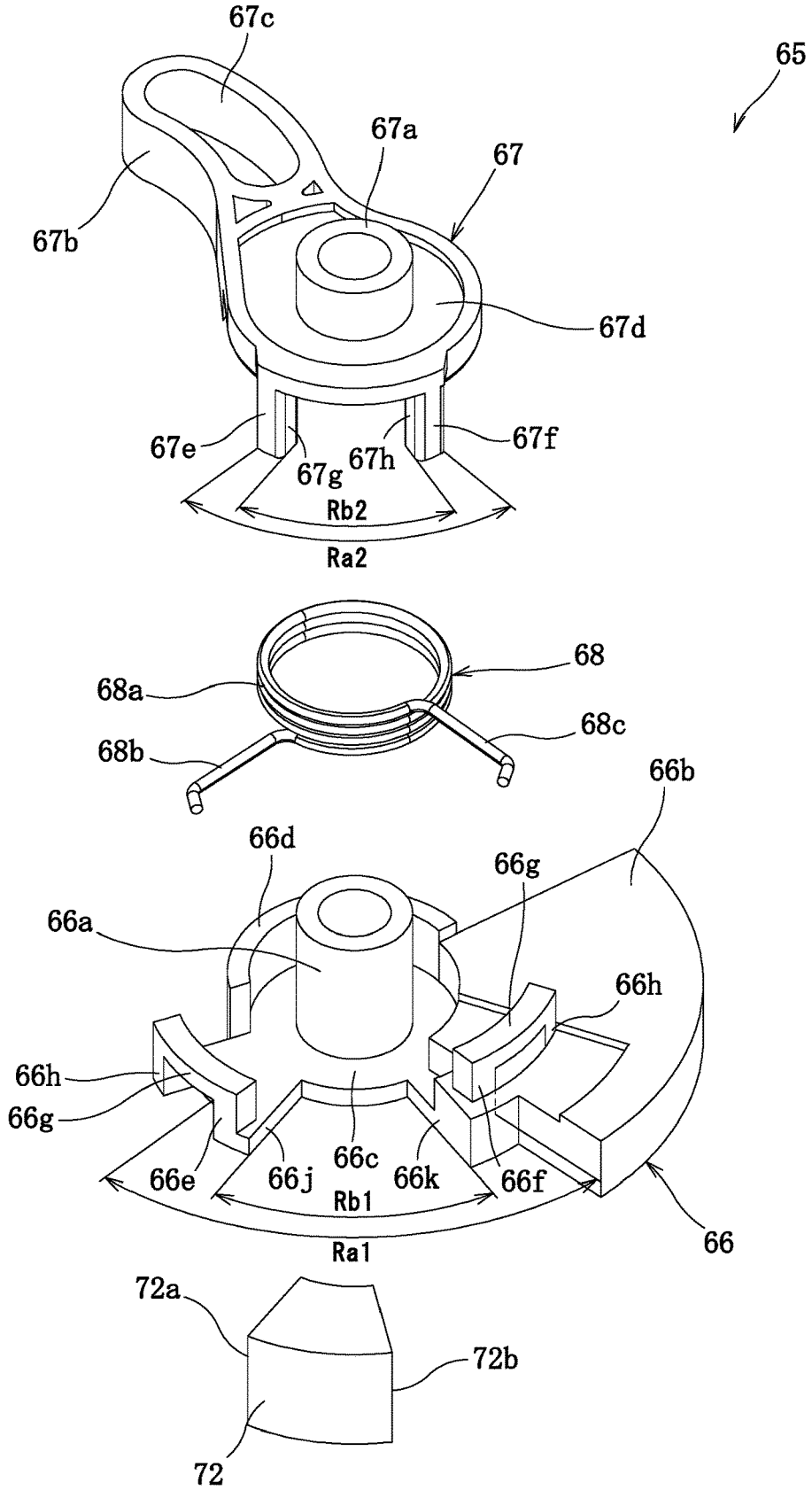
FIG. 10B is an exploded perspective view of the switching lever.

Specifically, as a panic countermeasure for the sub-lock mechanism 60, as illustrated in FIGS. 10A and 10B, the switching lever 65 includes the first rotating lever 66 and the second rotating lever 67. Further, the connection spring 68 that relatively rotatably connects the first rotating lever 66 and the second rotating lever 67 and the holding spring 69 that holds the first rotating lever 66 at the first working position and the second working position are provided.

As described above, the first rotating lever 66 includes the shaft portion 66*a* rotatably attached to the second housing portion 22 and the gear portion 66*b* protruding from the shaft portion 66*a*. The first rotating lever 66 is rotatable about the shaft portion 66*a* between the first working position illustrated in FIGS. 6A, 11A, and 11B and the second working position illustrated in FIGS. 7A, 12A, and 12B. The first rotating lever 66 is rotated by the ECU 5 to the first working position to move the bush 70 to the unlock position and to the second working position to move the bush 70 to the lock position.

As described above, the second rotating lever 67 includes the shaft portion 67*a* disposed on the same axis as the shaft portion 66*a* and the holding portion 67*b* for holding the bush 70. The second rotating lever 67 is rotatable about the shaft portion 67*a* in conjunction with the rotation of the first rotating lever 66 to the first rotation position illustrated in FIGS. 6A, 11A, and 11B and the second rotation position illustrated in FIGS. 7A, 12A, and 12B. The second rotating lever 67 is rotated to the first rotation position to move the bush 70 into the rotation track (unlock position) of the protruding portion 47*c*, and is rotated to the second rotation position to move the bush 70 out of the rotation track (lock position) of the protruding portion 47*c*.

As shown most clearly in FIG. 10B, the connection spring 68 is disposed between the first rotating lever 66 and the second rotating lever 67, and rotatably biases the second rotating lever 67 to the first rotating lever 66. Specifically, the connection spring 68 includes a torsion spring having a winding portion 68*a*, a first end portion 68*b*, and a second end portion 68*c*. The first end portion 68*b* biases the second rotating lever 67 to the first rotating lever 66 in a first direction A1 toward the first rotation position. The second end portion 68*c* biases the second rotating lever 67 to the first rotating lever 66 in a second direction A2 toward the second rotation position.

As shown most clearly in FIG. 10B, in the first rotating lever 66, a spring arrangement portion 66*c* where the winding portion 68*a* is disposed is provided concentrically with the shaft portion 66*a*. In the spring arrangement portion 66*c*, a substantially semi-cylindrical outer peripheral wall 66*d* continuous to one end of the gear portion 66*b* in the circumferential direction is formed.

A first locking portion 66*e* to which the first end portion 68*b* is locked and a second locking portion 66*f* to which the second end portion 68*c* is locked are provided on the opposite side of the outer peripheral wall 66*d* in the radial direction of the spring arrangement portion 66*c*. These locking portions 66*e* and 66*f* protrude radially outward with respect to the spring arrangement portion 66*c* and are formed at intervals in the circumferential direction. A fan-shaped gap in which a stopper 72 to be described later is disposed is formed between the locking portions 66*e* and 66*f*. The first locking portion 66*e* also functions as a stopper that restricts the biasing of the first end portion 68*b*, and the second locking portion 66*f* also functions as a stopper that restricts the biasing of the second end portion 68*c*. An outer frame portion 66*g* is provided at the end of the locking portions 66*e* and 66*f*, and a restricting portion 66*h* is provided at the end of the outer frame portion 66*g*, and these define a slit through which the end portions 68*a* and 68*b* can move while preventing detachment of the end portions 68*a* and 68*b*.

The second rotating lever 67 includes a substantially disk-shaped cover portion 67*d* that covers the outer end of the spring arrangement portion 66*c*. A first locking portion 67*e* to which the first end portion 68*b* is locked and a second locking portion 67*f* to which the second end portion 68*c* is locked are provided on the outer periphery of the cover portion 67*d*. These protrude in a rod shape toward the first rotating lever 66, and are formed at intervals in the circumferential direction so as to be adjacent to the inner side in the radial direction of the locking portions 66*e* and 66*f*.

As illustrated in FIG. 10A, in a case where no load is applied to the second rotating lever 67, the first end portion 68*b* of the connection spring 68 is locked to the first locking portion 66*e* of the first rotating lever 66 and the first locking portion 67*e* of the second rotating lever 67. Further, the second end portion 68*c* of the connection spring 68 is locked to the second locking portion 66*f* of the first rotating lever 66 and the second locking portion 67*f* of the second rotating lever 67. That is, an angular range Ra1 from the first locking portion (surface) 66*e* of the first rotating lever 66 to the second locking portion 66*f* (surface) and an angular range Ra2 from the first locking portion (surface) 67*e* of the second rotating lever 67 to the second locking portion 67*f* (surface) illustrated in FIG. 10B are formed substantially the same. In this manner, the first rotating lever 66 and the second rotating lever 67 are connected without rattling via the connection spring 68, and integrally rotate as illustrated in FIGS. 11A and 11B and FIGS. 12A and 12B.

Figure 11A:
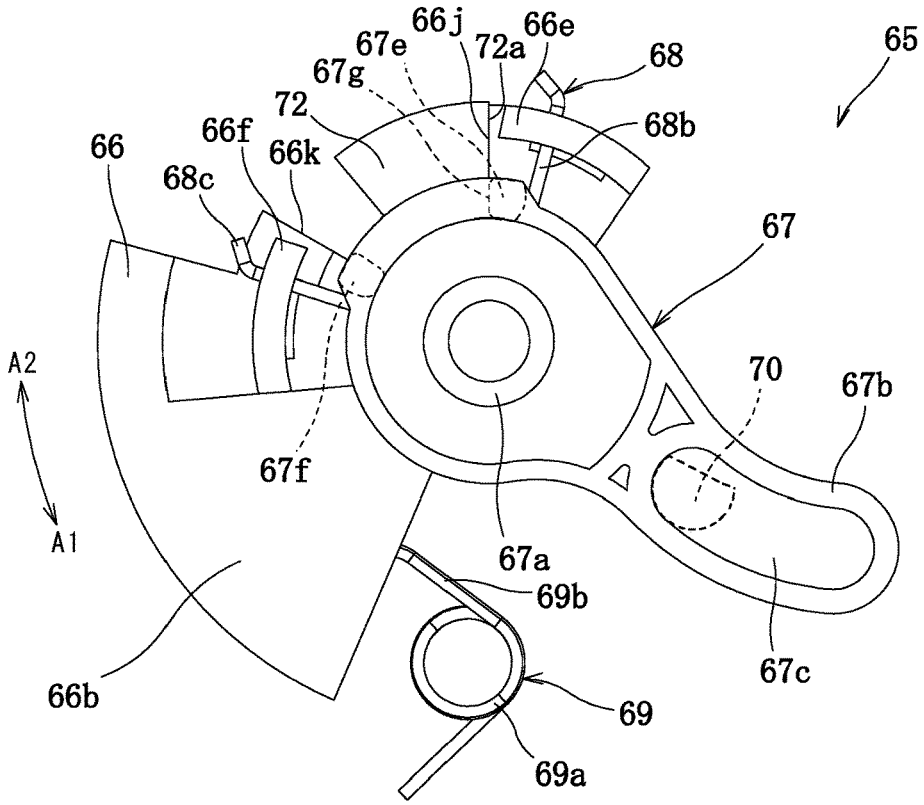
FIG. 11A is a front view of the switching lever in an unlocked state.
Figure 11B:
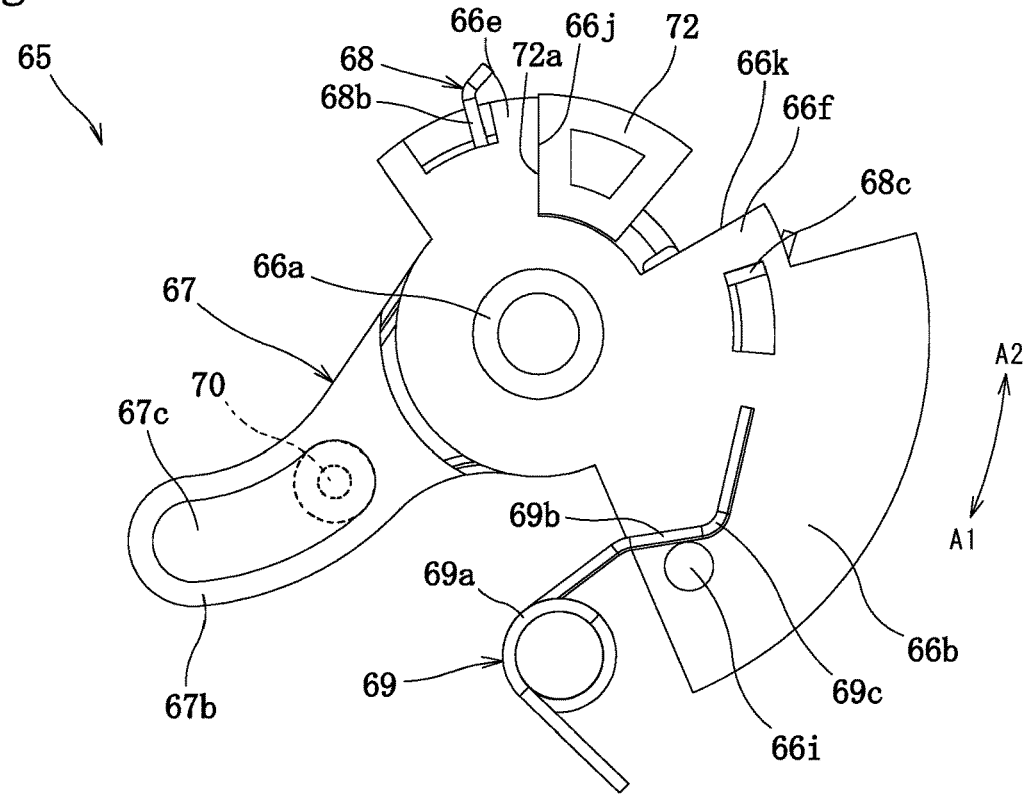
FIG. 11B is a rear view of the switching lever in the unlocked state.
Figure 11C:
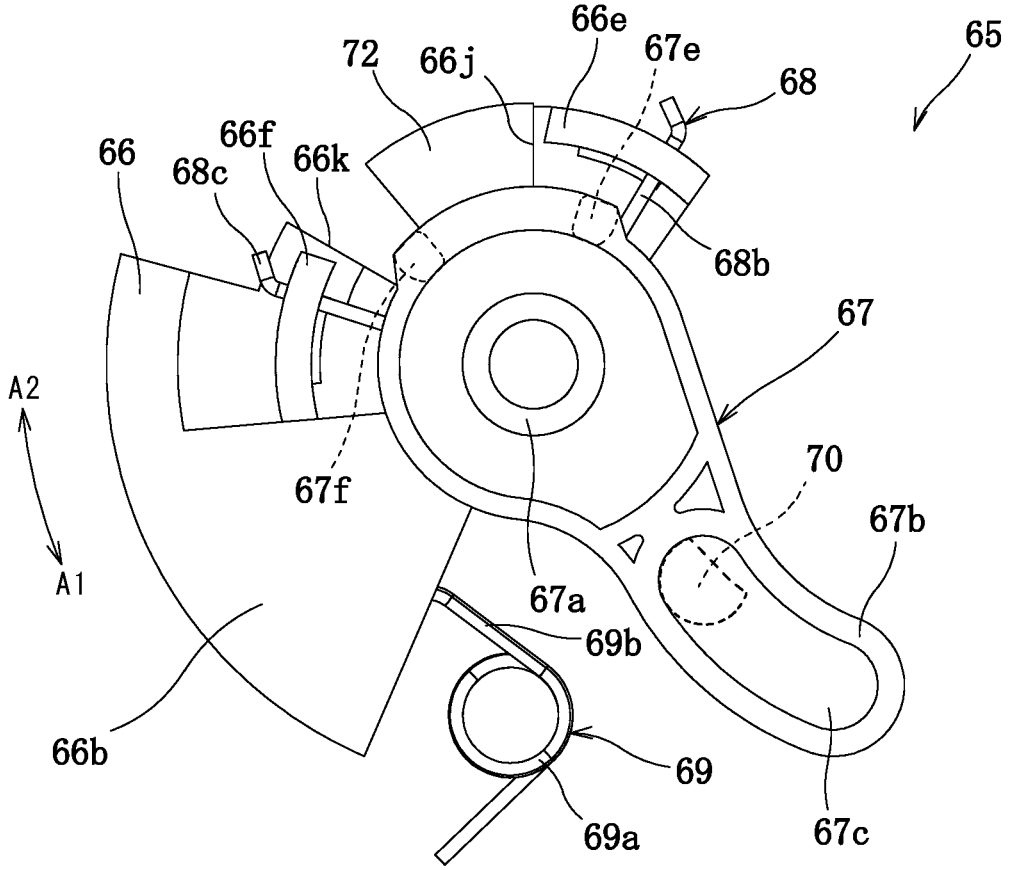
FIG. 11C is a front view illustrating a state in which a second rotating lever rotates to a second rotation position with respect to a first rotating lever at a first working position.
Figure 12A:
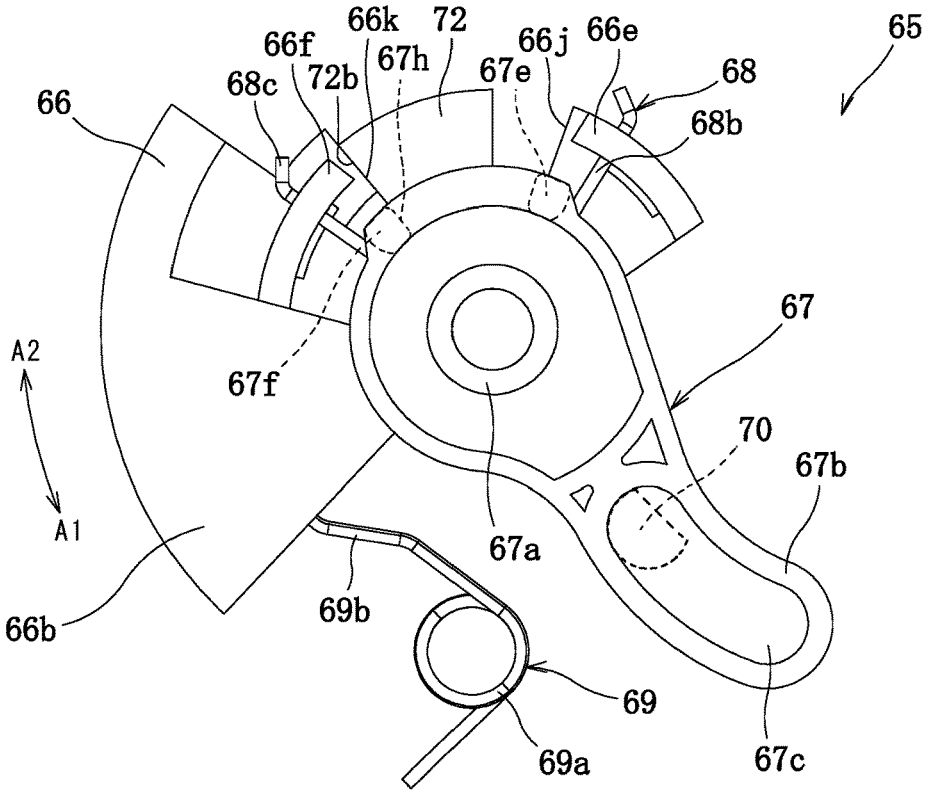
FIG. 12A is a front view of the switching lever in a locked state.
Figure 12B:
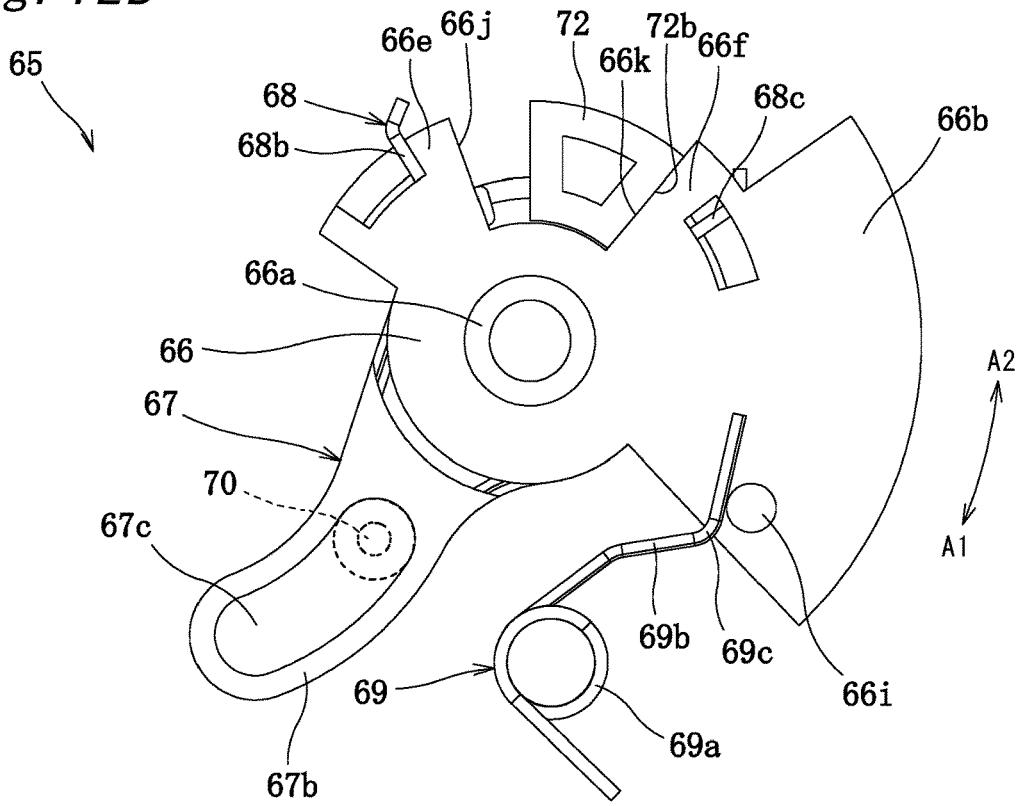
FIG. 12B is a rear view of the switching lever in the locked state.
Figure 12C:
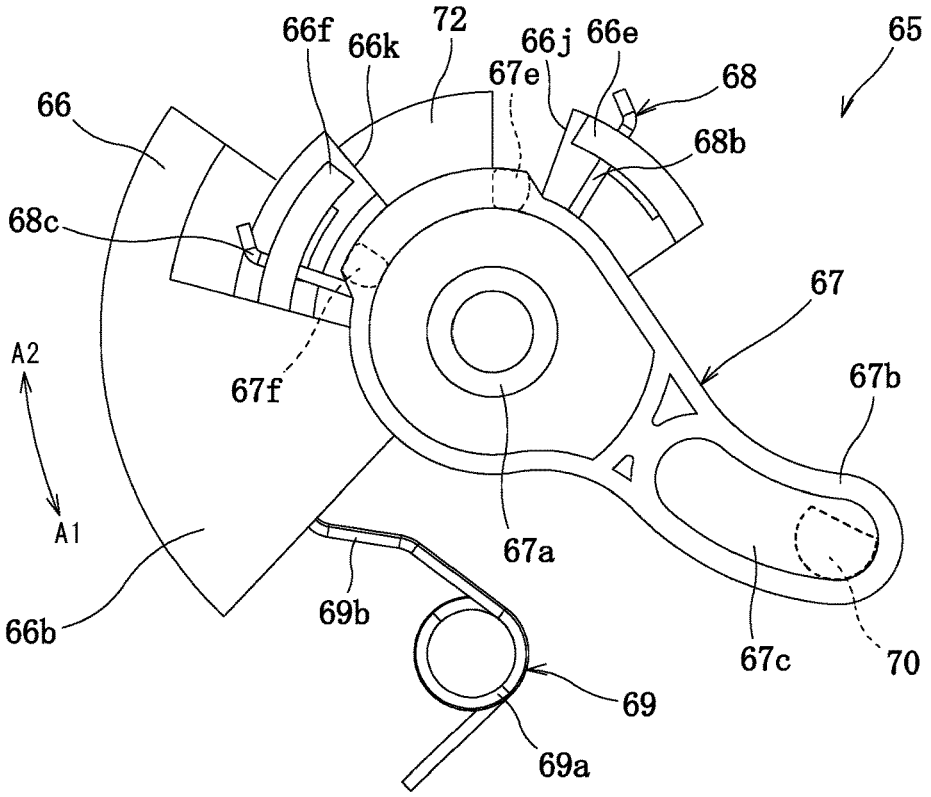
FIG. 12C is a front view illustrating a state in which the second rotating lever rotates to a first rotation position with respect to the first rotating lever at a second working position.

FIG. 11C illustrates a state in which a load is applied to the second rotating lever 67 at the second rotation position, and FIG. 12C illustrates a state in which a load is applied to the second rotating lever 67 at the first rotation position. In these cases, as shown in FIGS. 11A and 11C and FIGS. 12A and 12C, the connection spring 68 allows the relative rotation of the first rotating lever 66 and the second rotating lever 67. Specifically, as illustrated in FIG. 11C, with respect to the first rotating lever 66 at the first working position, the first end portion 68*b* of the connection spring 68 allows the rotation of the second rotating lever 67 to the second rotation position, and biases the second rotating lever 67 toward the first rotation position. Further, as illustrated in FIG. 12C, with respect to the first rotating lever 66 at the second working position, the second end portion 68*c* of the connection spring 68 allows the rotation of the second rotating lever 67 to the first rotation position, and biases the second rotating lever 67 toward the second rotation position.

However, in a case where the rotation of the first rotating lever 66 is not restricted, the first rotating lever 66 rotates with respect to the second rotating lever 67 to which a load is applied by the biasing force of the connection spring 68. Therefore, for rotation of the second rotating lever 67 with reference to the first rotating lever 66, the holding spring 69 that restricts the rotation of the first rotating lever 66 is provided.

The holding spring 69 is disposed between the second housing portion 22 and the first rotating lever 66. As illustrated in FIGS. 11B and 12B, the holding spring 69 includes an action spring including a winding portion 69*a* and a biasing portion 69*b*. An end portion on the side opposite to the biasing portion 69*b* of the winding portion 69*a* is locked to the second housing portion 22 so as to be non-rotatably fixed to the second housing portion 22. The biasing portion 69*b* is bent in a substantially V shape, and a top portion 69*c* of the biasing portion 69*b* is disposed at the center between the first working position and the second working position of the first rotating lever 66. On a bottom surface of the first rotating lever 66 facing the second housing portion 22, a biased portion 66*i* biased by sliding contact of the top portion 69*c* is provided to protrude in a columnar shape. The biasing force of the holding spring 69 is stronger than the biasing force of the connection spring 68.

When the first rotating lever 66 at the second working position illustrated in FIGS. 12A and 12B rotates to the first working position side (first direction A1) illustrated in FIGS. 11A and 11B, and the biased portion 66*i* moves beyond the top portion (specific position) 69*c*, the holding spring 69 biases the first rotating lever 66 to the first working position. Conversely, when the first rotating lever 66 at the first working position rotates toward the second working position side (second direction A2), and the biased portion 66*i* moves beyond the top portion 69*c*, the holding spring 69 biases the first rotating lever 66 to the second working position.

Therefore, as illustrated in FIG. 6B, even in a case where the sub-lock mechanism 60 is driven to lock in a state where the bush 70 moves to the unlock position and the connection lever 47 is operated, the driving for locking can be reliably performed. Further, as illustrated in FIG. 7B, even in a case where the sub-lock mechanism 60 is driven to unlock in a state where the bush 70 moves to the unlock position and the connection lever 47 is operated, the driving for unlocking can be reliably performed.

Referring to FIG. 8, the protruding portion 47*c* of the connection lever 47 with which the bush 70 interferes is provided with an arc-shaped sliding contact edge 47*e* around the mounting hole 47*a* on the outer edge facing the bush 70 at the lock position. The sliding contact edge 47*e* is provided to allow the connection lever 47 to rotate from the operation position to the non-operation position in a state where the bush 70 is pressed (caused to abut) by the biasing force of the connection spring 68 during the unlocking driving illustrated in FIG. 7C.

Next, the operation of the sub-lock mechanism 60 in the operating state of the inner handle 3 will be described.

Figure 7C:
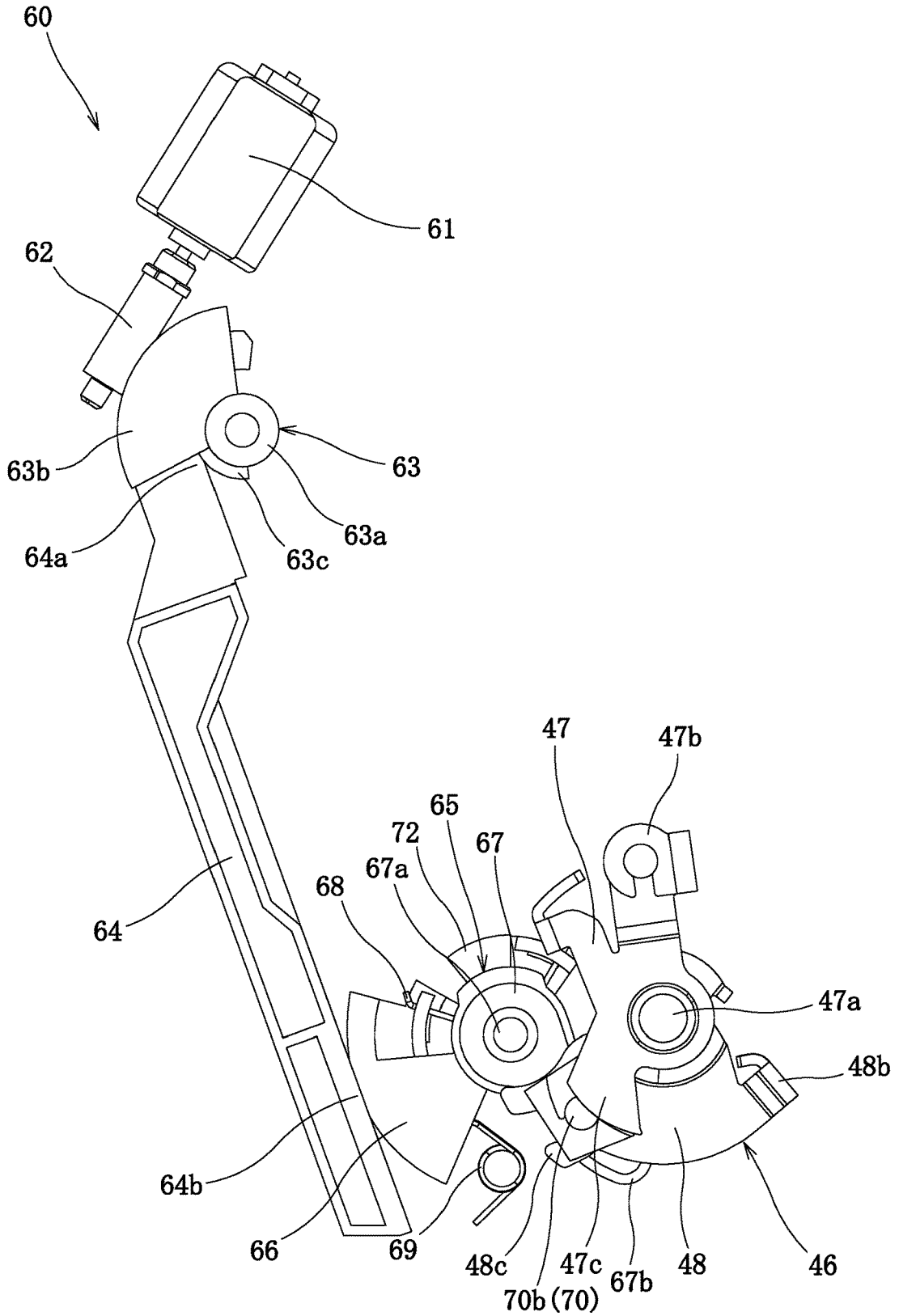
FIG. 7C is a front view illustrating a state in which the sub-lock mechanism is driven to unlock in the state of FIG. 7B.

As shown in FIGS. 7B and 7C, in the case of the unlocking driving, the bush 70 interferes with the protruding portion 47*c*, so that the first rotating lever 66 at the second working position is rotated to the first working position. However, the second rotating lever 67 is maintained in a state of being substantially rotated to the second rotation position. Then, when the operation of the inner handle 3 is stopped and the connection lever 47 is rotated to the non-operation position and the interference between the bush 70 and the protruding portion 47*c* is released, the second rotating lever 67 is rotated to the first rotation position by the connection spring 68 with respect to the first rotating lever 66 held at the first working position by the holding spring 69. In this manner, the bush 70 moves to the unlock position.

Figure 6C:
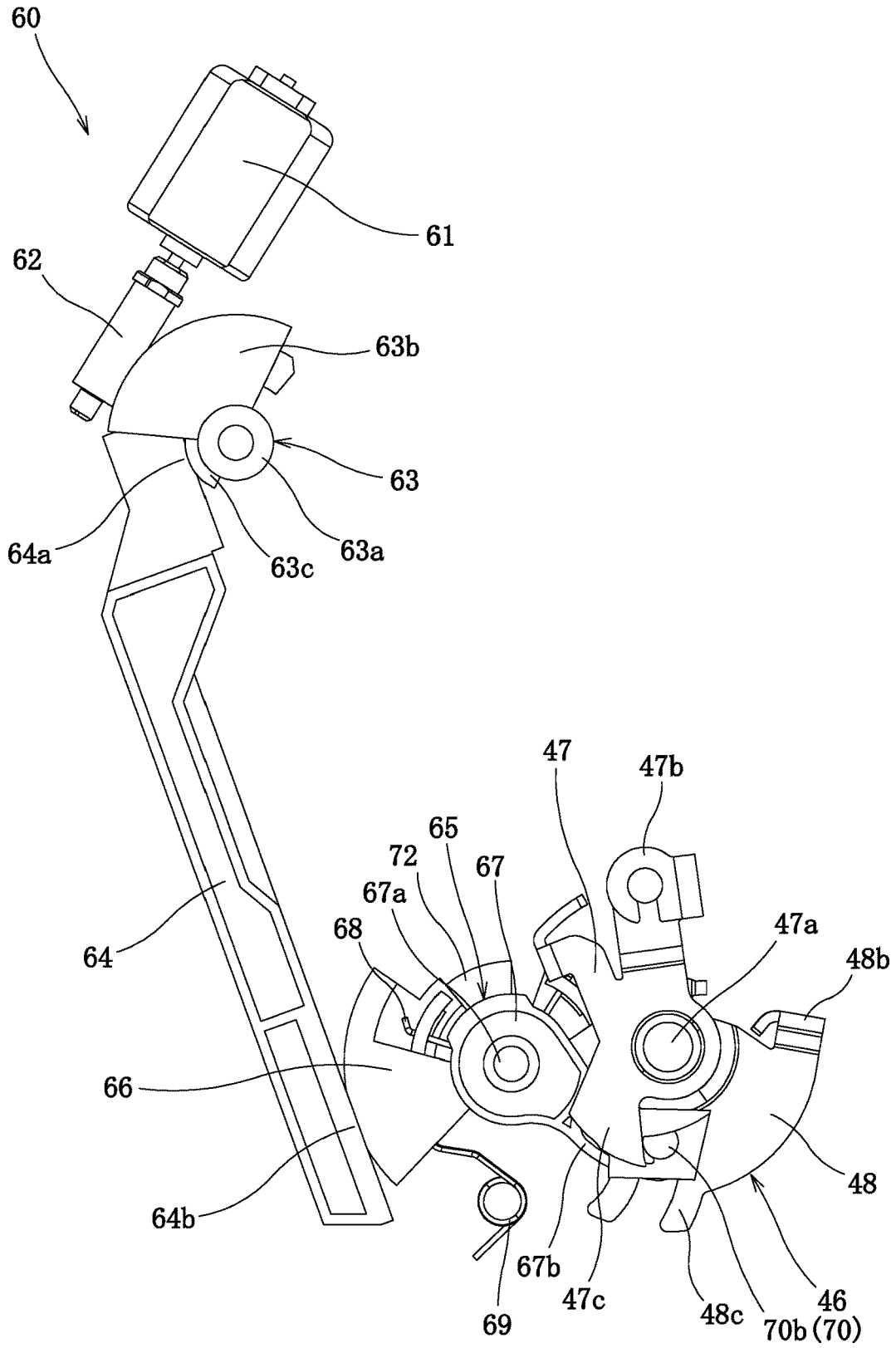
FIG. 6C is a front view illustrating a state in which the sub-lock mechanism is driven to lock in the state of FIG. 6B.

As shown in FIGS. 6B and 6C, in the case of the locking driving, the bush 70 interferes with the connection lever 47, so that the first rotating lever 66 at the first working position is rotated to the second working position. However, the second rotating lever 67 is maintained in a state of being rotated to the first rotation position. Then, when the operation of the inner handle 3 is stopped and the connection lever 47 is rotated to the non-operation position and the interference between the bush 70 and the connection lever 47 is released, the second rotating lever 67 is rotated to the second rotation position by the connection spring 68 with respect to the first rotating lever 66 held at the second working position by the holding spring 69. In this manner, the bush 70 moves to the lock position.

As described above, in the door latch device 10 of the present embodiment, even if the sub-lock mechanism 60 is driven during the operation of the inner handle 3, the sub-lock mechanism 60 can be switched to the unlocked state or the locked state after the operation of the inner handle 3 is finished. Accordingly, the problem that the sub-lock mechanism 60 is not switched even though the user performs the switching operation can be solved, so that the safety of the door latch device 10 can be improved.

Further, since the protruding portion 47*c* of the connection lever 47 includes the sliding contact edge 47*e*, even if the bush 70 interferes with the protruding portion 47*c* at the time of unlocking driving, the sliding contact edge 47*e* comes into sliding contact with the bush 70, and it is possible to prevent catching between them. Therefore, since the connection lever 47 at the operation position can be reliably rotated to the non-operation position, the sub-lock mechanism 60 can be reliably switched to the unlocked state.

Further, in the door latch device 10 of the present embodiment, a structure capable of preventing the second rotating lever 67 from vibrating and generating abnormal noise due to vibration at the time of traveling of the vehicle or the like is used. Specifically, since the first rotating lever 66 is constantly biased by the holding spring 69, abnormal noise due to vibration is not generated. Although the second rotating lever 67 is biased by the connection spring 68, in a case where the first end portion 68*b* and the second end portion 68*c* are also locked to the first rotating lever 66, there is a possibility that the second rotating lever 67 vibrates due to a manufacturing error and generates abnormal noise. Therefore, in the present embodiment, when the second rotating lever 67 rotates to the first rotation position and the second rotation position, the second rotating lever 67 can be maintained in a biased state by the connection spring 68.

Specifically, as illustrated in FIG. 10B, a rubber stopper 72 is disposed between the first locking portion 66*e* and the second locking portion 66*f* of the first rotating lever 66 and between the first locking portion 67*e* and the second locking portion 67*f* of the second rotating lever 67. The stopper 72 has a fan shape around the shaft portions 66*a* and 67*a*, and regulates the rotation of the first rotating lever 66 toward the first working position and the second working position and the rotation of the second rotating lever 67 toward the first rotation position and the second rotation position.

The first rotating lever 66 includes a first abutment portion 66*j* that abuts on a first end surface 72*a* of the stopper 72 by the rotation of the first rotating lever 66 to the first working position, and a second abutment portion 66*k* that abuts on a second end surface 72*b* of the stopper 72 by the rotation of the first rotating lever 66 to the second working position. The first abutment portion 66*j* is a surface extending in the radial direction about the shaft portion 66*a*, and protrudes from the first locking portion 66*e* toward the second locking portion 66*f*. The second abutment portion 66*k* is a surface extending in the radial direction about the shaft portion 66*a*, and protrudes from the second locking portion 66*f* toward the first locking portion 66*e*.

Referring to FIGS. 11A and 11B, in a state where the first abutment portion 66*j* abuts on the stopper 72, a gap having an angular range that allows rotation from the first working position to the second working position is formed between the second abutment portion 66*k* and the stopper 72. Referring to FIGS. 12A and 12B, in a state where the second abutment portion 66*k* abuts on the stopper 72, a gap having an angular range that allows rotation from the second working position to the first working position is formed between the first abutment portion 66*j* and the stopper 72.

As illustrated in FIG. 10B, the second rotating lever 67 includes a first abutment portion 67*g* that abuts on the first end surface 72*a* of the stopper 72 by the rotation of the second rotating lever 67 to the first rotation position, and a second abutment portion 67*h* that abuts on the second end surface 72*b* of the stopper 72 by the rotation of the second rotating lever 67 to the second rotation position. The first abutment portion 67*g* includes an end surface of the first locking portion 67*e* facing the second locking portion 67*f*. The second abutment portion 67*h* includes an end surface of the second locking portion 67*f* facing the first locking portion 67*e*.

In a state where the first abutment portion 67*g* abuts on the stopper 72, a gap having an angular range that allows rotation from the first rotation position to the second rotation position is formed between the second abutment portion 67*h* and the stopper 72. In a state where the second abutment portion 67*h* abuts on the stopper 72, a gap having an angular range that allows rotation from the second rotation position to the first rotation position is formed between the first abutment portion 67*g* and the stopper 72.

Referring to FIG. 10B, as described above, the angular range Ra1 between a pair of the locking portions 66*e* and 66*f* of the first rotating lever 66 and the angular range Ra2 between a pair of locking the portions 67*e* and 67*f* of the second rotating lever 67 are substantially the same. In contrast, an angular range Rb1 from the first abutment portion (surface) 66*j* to the second abutment portion (surface) 66*k* of the first rotating lever 66 is formed to be wider than an angular range Rb2 from the first abutment portion (surface) 67*g* to the second abutment portion (surface) 67*h* of the second rotating lever 67.

In this manner, in a state where the first end portion 68*b* of the connection spring 68 is locked to the first locking portions 66*e* and 67*e* of both the rotating levers 66 and 67, the first abutment portion 67*g* of the second rotating lever 67 protrudes from the first abutment portion 66*j* of the first rotating lever 66 toward the stopper 72. Further, in a state where the second end portion 68*c* of the connection spring 68 is locked to the second locking portions 66*f* and 67*f* of both the rotating levers 66 and 67, the second abutment portion 67*h* of the second rotating lever 67 protrudes from the second abutment portion 66*k* of the first rotating lever 66 toward the stopper 72.

By setting of the angular ranges Ra1, Ra2, Rb1, and Rb2, in a state where the second rotating lever 67 rotates to the first rotation position and the second rotation position, the abutment portions 67*g* and 67*h* of the second rotating lever 67 can be pressed against the stopper 72 by the connection spring 68.

Specifically, as illustrated in FIGS. 11A and 11B, in a state where the first rotating lever 66 rotates to the first working position and the second rotating lever 67 rotates to the first rotation position, the first abutment portions 66*j* and 67*g* of both of them abut on the stopper 72. In this manner, the first end portion 68*b* of the connection spring 68 is locked only to the first locking portion 67*e* of the second rotating lever 67 and is separated from the first locking portion 66*e* of the first rotating lever 66 due to a difference in the angular ranges between the first abutment portions 66*j* and 67*g* of both of them. Further, the second end portion 68*c* of the connection spring 68 is locked only to the second locking portion 66*f* of the first rotating lever 66, and is separated from the second locking portion 67*f* of the second rotating lever 67. In this state, the first rotating lever 66 is held at the first working position by the holding spring 69. Therefore, the first abutment portion 67*g* of the second rotating lever 67 is pressed against the stopper 72 by the biasing force of the connection spring 68. Therefore, it is possible to prevent the second rotating lever 67 from rattling and generating abnormal noise in this state.

As illustrated in FIGS. 12A and 12B, in a state where the first rotating lever 66 rotates to the second working position and the second rotating lever 67 rotates to the second rotation position, the second abutment portions 66*k* and 67*h* of both of them abut on the stopper 72. In this manner, the second end portion 68*c* of the connection spring 68 is locked only to the second locking portion 67*f* of the second rotating lever 67 and is separated from the second locking portion 66*f* of the first rotating lever 66 due to a difference in the angular ranges between the second abutment portions 66*k* and 67*h* of both of them. Further, the first end portion 68*b* of the connection spring 68 is locked only to the first locking portion 66*e* of the first rotating lever 66, and is separated from the first locking portion 67*e* of the second rotating lever 67. In this state, the first rotating lever 66 is held at the second working position by the holding spring 69. Therefore, the second abutment portion 67*h* of the second rotating lever 67 is pressed against the stopper 72 by the biasing force of the connection spring 68. Therefore, it is possible to prevent the second rotating lever 67 from rattling and generating abnormal noise in this state.

As described above, in the door latch device 10 of the present embodiment, even if the bush 70 interferes with the connection lever 47 during the unlocking driving and the locking driving, the sub-lock mechanism 60 can be switched by the connection spring 68 after the end of the operation of the inner handle 3. Therefore, the safety of the door latch device 10 can be improved.

Since the holding groove 67*c* of the second rotating lever 67 and the guide groove 48*c* of the actuation lever 48 cross each other, the bush 70 can be reliably moved to the unlock position and the lock position, and the operating force of the connection lever 47 can be reliably transmitted to the actuation lever 48 via the bush 70.

Since the rotation of the first rotating lever 66 and the rotation of the second rotating lever 67 are restricted by one of the stopper 70, the number of components constituting the sub-lock mechanism 60 can be reduced. Further, since rattling of the second rotating lever 67 can be prevented by the stopper 70, generation of abnormal noise due to vibration or the like during traveling can be prevented. Since the first rotating lever 66 is provided with the gear portion 66*b* that receives the driving force of the motor 61, a gear composed of a separate component is unnecessary. Therefore, also in this respect, the number of components constituting the sub-latch mechanism 60 can be reduced.

Note that the door latch device 10 of the present invention is not limited to the configuration of the above embodiment, and various changes can be made.

Figure 13:
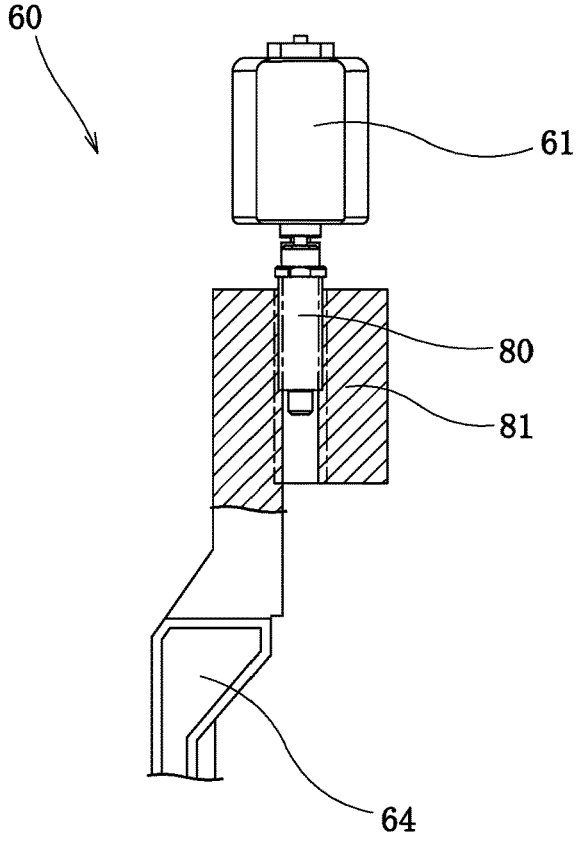
FIG. 13 is a schematic view illustrating a variation of a drive mechanism of the sub-lock mechanism.

For example, as shown in FIG. 13, the joint 64 of the sub-lock mechanism 60 may be moved by the motor 61 via a ball screw mechanism. Specifically, a screw shaft 80 may be/disposed on the output shaft of the motor 61, a nut portion 81 may be provided at the upper end of the joint 64, and the joint 64 may be linearly moved in the vertical direction by engagement between the screw shaft 80 and the nut portion 81. In this way, the number of components constituting the sub-latch mechanism 60 can be reduced.

The configuration of the connection spring 68 that relatively rotatably connects the first rotating lever 66 and the second rotating lever 67 and the configuration of the holding spring 69 that holds the first rotating lever 66 at the first working position and the second working position can be changed as necessary. Further, the configurations of the locking portion and the abutment portion of the first rotating lever 66 and the second rotating lever 67 can also be changed as necessary.

The main lock mechanism 50 may be a lock mechanism dedicated to the outer handle 2. That is, the configuration may be such that switching is made between the unlocked state in which the operation of the outer handle 2 is enabled and the locked state in which the operation is disabled, and the operation of the inner handle 3 is not disabled.

The invention claimed is:

1. A door latch device comprising:

a latch mechanism that locks a striker and holds a door in a closed state;

an inner lever that releases locking of the striker by the latch mechanism; and a first lock mechanism including a first motor for making switching between a first unlocked state in which operation of the inner lever is enabled and a first locked state in which operation of the inner lever is disabled, wherein the inner lever includes a connection lever that is operated by operation of an inner handle, and an actuation lever for operating the latch mechanism, and the first lock mechanism includes a connection member movable to an unlock position where operation of the connection lever can be transmitted to the actuation lever and a lock position where operation of the connection lever cannot be transmitted to the actuation lever, a first rotating lever that is rotated by driving of the first motor to a first working position for moving the connection member to the unlock position and a second working position for moving the connection member to the lock position, a second rotating lever that has a rotation shaft located on a same axis as a rotation shaft of the first rotating lever, holds the connection member, and is rotatable between a first rotation position where the connection member is moved to the unlock position and a second rotation position where the connection member is moved to the lock position, a connection spring that rotatably connects the second rotating lever to the first rotating lever, allows rotation of the second rotating lever to the second rotation position with respect to the first rotating lever at the first working position and biases the second rotating lever toward the first rotation position, and allows rotation of the second rotating lever to the first rotation position with respect to the first rotating lever at the second working position and biases the second rotating lever toward the second rotation position, and a holding spring that has a biasing force stronger than a biasing force of the connection spring, biases the first rotating lever rotated to the first working position side beyond a specific position between the first working position and the second working position to the first working position and holds the first rotating lever, and biases the first rotating lever rotated to the second working position side beyond the specific position to the second working position and holds the first rotating lever.

2. The door latch device according to claim 1, further comprising a second lock mechanism including a second motor for making switching between a second unlocked state in which locking of the striker by the latch mechanism can be released by operation of an outer handle and a second locked state in which the locking cannot be released by operation of the outer handle.

3. The door latch device according to claim 2, wherein the connection spring is a torsion spring having a first end that biases the second rotating lever toward the first rotation position side with respect to the first rotating lever and a second end that biases the second rotating lever toward the second rotation position side with respect to the first rotating lever, and each of the first rotating lever and the second rotating lever includes a first locking portion to which the first end is locked and a second locking portion to which the second end is locked.

4. The door latch device according to claim 1, wherein the connection spring is a torsion spring having a first end that biases the second rotating lever toward the first rotation position side with respect to the first rotating lever and a second end that biases the second rotating lever toward the second rotation position side with respect to the first rotating lever, and each of the first rotating lever and the second rotating lever includes a first locking portion to which the first end is locked and a second locking portion to which the second end is locked.

5. The door latch device according to claim 4, wherein a stopper that restricts rotation of the first rotating lever and rotation of the second rotating lever is disposed between the first locking portion and the second locking portion, the first rotating lever includes a first abutment portion that abuts on the stopper by rotation to the first working position and a second abutment portion that abuts on the stopper by rotation to the second working position, and the second rotating lever includes a first abutment portion that abuts on the stopper by rotation to the first rotation position and a second abutment portion that abuts on the stopper by rotation to the second rotation position.

6. The door latch device according to claim 5, wherein the first abutment portion of the second rotating lever protrudes from the first abutment portion of the first rotating lever toward the stopper in a state where the first end of the connection spring is locked to the first locking portion of the first rotating lever and the first locking portion of the second rotating lever.

7. The door latch device according to claim 6, wherein the second abutment portion of the second rotating lever protrudes from the second abutment portion of the first rotating lever toward the stopper in a state where the second end of the connection spring is locked to the second locking portion of the first rotating lever and the second locking portion of the second rotating lever.

8. The door latch device according to claim 5, wherein the second abutment portion of the second rotating lever protrudes from the second abutment portion of the first rotating lever toward the stopper in a state where the second end of the connection spring is locked to the second locking portion of the first rotating lever and the second locking portion of the second rotating lever.

9. The door latch device according to claim 8, wherein the first rotating lever is provided with a gear portion that receives a driving force of the first motor.

10. The door latch device according to claim 1, wherein the first rotating lever is provided with a gear portion that receives a driving force of the first motor.

11. The door latch device according to claim 10, wherein the connection lever includes a protruding portion that protrudes toward the connection member and is capable of abutting on the connection member at the unlock position by rotation of the connection lever from a non-operation position to an operation position by the inner handle, and the protruding portion includes a sliding contact edge facing the connection member at the lock position and allowing rotation of the connection lever from the operation position toward the non-operation position in an abutting state of the connection member.

12. The door latch device according to claim 1, wherein the connection lever includes a protruding portion that protrudes toward the connection member and is capable of abutting on the connection member at the unlock position by rotation of the connection lever from a non-operation position to an operation position by the inner handle, and the protruding portion includes a sliding contact edge facing the connection member at the lock position and allowing rotation of the connection lever from the operation position toward the non-operation position in an abutting state of the connection member.

13. The door latch device according to claim 12, wherein the actuation lever has a guide groove that guides the connection member to the unlock position and the lock position.

14. The door latch device according to claim 1, wherein the actuation lever has a guide groove that guides the connection member to the unlock position and the lock position.

15. The door latch device according to claim 14, wherein the second rotating lever has a holding groove that movably holds the connection member, and the holding groove crosses the guide groove.

16. The door latch device according to claim 15, further comprising a control unit that controls the first motor based on operation of a child lock changeover switch disposed in a vehicle.

17. The door latch device according to claim 1, further comprising a control unit that controls the first motor based on operation of a child lock changeover switch disposed in a vehicle.

* * * * *